US012667169B2

(12) United States Patent
Olmstead et al.

(10) Patent No.: US 12,667,169 B2
(45) Date of Patent: Jun. 30, 2026

(54) WATCHBANDS WITH HOOK AND LOOP FASTENERS

(71) Applicant: Apple Inc., Cupertino, CA (US)

(72) Inventors: Donald L. Olmstead, Aptos, CA (US); Ayumi Kusano, Tokyo (JP); Clement C. Tissandier, San Francisco, CA (US); Eiryo Shiraishi, Tokyo (JP); Mengxi Zhao, Shanghai (CN); Molly J. Anderson, San Francisco, CA (US); Osamu Yabe, Mountain View, CA (US); Seul Bi Kim, San Mateo, CA (US); Tirshathah A Hunter, San Leandro, CA (US); Yoji Hamada, Wakayama (JP)

(73) Assignee: Apple Inc., Cupertino, CA (US)

( * ) Notice: Subject to any disclaimer, the term of this patent is extended or adjusted under 35 U.S.C. 154(b) by 242 days.

(21) Appl. No.: 18/138,547

(22) Filed: Apr. 24, 2023

(65) Prior Publication Data

US 2024/0074549 A1 Mar. 7, 2024

Related U.S. Application Data

(63) Continuation of application No. PCT/CN2022/116491, filed on Sep. 1, 2022.

(51) Int. Cl.

| | |
|---|---|
| ***A44C 5/00*** | (2006.01) |
| ***A44C 5/16*** | (2006.01) |
| ***A44C 5/20*** | (2006.01) |

(52) U.S. Cl.

CPC ..... *A44C 5/0053* (2013.01); *A44C 5/16* (2013.01); *A44C 5/2071* (2013.01)

(58) Field of Classification Search

CPC ..... A44C 5/0053; A44C 5/14; A44C 5/2071; A44D 2205/00; G04B 37/14

(Continued)

(56) References Cited

U.S. PATENT DOCUMENTS 4,162,754 A * 7/1979 Fleming ..... A44C 5/0046 D19/127
4,639,144 A * 1/1987 Chau ..... G04B 37/1486 368/282

(Continued)

FOREIGN PATENT DOCUMENTS

AT 388300 5/1989
CN 107581726 A * 1/2018 ..... A44C 5/0069

(Continued)

OTHER PUBLICATIONS

Korean Office Action from Korean Patent Application No. 10-2023-7029872, dated Nov. 15, 2024, 13 pages with English language translation.

(Continued)

*Primary Examiner* — Jason W San
*Assistant Examiner* — Anna S Rashid
(74) *Attorney, Agent, or Firm* — BAKERHOSTETLER

(57) ABSTRACT

A watchband can comfortably secure an electronic device to a wrist of a user. The watchband can include a base having a contact surface opposite an engagement surface, contact loops on the contact surface for contacting a user, and engagement loops on the engagement surface for engaging hooks. The hooks can be provided on the engagement surface, opposite some of the contact loops. Edge sections of the base can wrap around a central section to define an end of the base. A tab can extend from an end of the base to facilitate attachment, adjustment, and/or removal of the watch band. The tab can further help maintain the assembled parts in place to enhance durability of the watchband.

20 Claims, 16 Drawing Sheets

(58) Field of Classification Search
USPC ..... 368/282; 428/99, 100
See application file for complete search history.

(56) References Cited

U.S. PATENT DOCUMENTS

| | | | | | |
|---|---|---|---|---|---|
| 4,742,503 | A * | 5/1988 | Braun | G04B 37/1486 | 368/282 |
| 4,855,974 | A * | 8/1989 | Steinmann | A44B 11/18 | 224/175 |
| 4,878,148 | A * | 10/1989 | Hee | H05F 3/02 | 66/193 |
| 5,332,135 | A * | 7/1994 | Fletcher | G04B 37/005 | 224/171 |
| 5,425,007 | A * | 6/1995 | Walter | A44C 5/22 | 368/282 |
| 6,073,821 | A * | 6/2000 | Mercer | A44C 5/22 | 368/282 |
| 6,179,177 | B1 * | 1/2001 | Hihara | A44C 5/145 | 24/70 J |
| 6,199,730 | B1 * | 3/2001 | Chisolm | A44C 5/0053 | 224/166 |
| 6,276,580 | B1 * | 8/2001 | Kitahara | A44C 5/14 | 224/178 |
| 6,443,187 | B1 * | 9/2002 | Wang | A44C 5/0053 | 24/445 |
| 6,921,006 | B2 * | 7/2005 | Bauer | G04B 37/1486 | 368/282 |
| 8,752,740 | B2 * | 6/2014 | Morgan | A45F 5/00 | 224/222 |
| 10,754,298 | B2 * | 8/2020 | Kaneko | G04B 37/0008 | |
| 10,966,492 | B2 * | 4/2021 | Green | A44C 5/20 | |
| 11,033,083 | B1 * | 6/2021 | Moustafa | A44C 5/16 | |
| D962,106 | S * | 8/2022 | Jiang | D11/3 | |
| D984,301 | S * | 4/2023 | Sun | D11/3 | |
| D1,021,665 | S * | 4/2024 | Ou | D11/3 | |
| 12,004,610 | B1 * | 6/2024 | Zhang | A44C 5/0053 | |
| 12,127,643 | B1 * | 10/2024 | Lallo | A44C 5/2023 | |
| D1,054,899 | S * | 12/2024 | Botero | D11/3 | |
| 2003/0172436 | A1 * | 9/2003 | Thompson | F41B 15/00 | 2/170 |
| 2008/0223889 | A1 * | 9/2008 | Rossell | A44C 5/0007 | 224/222 |
| 2009/0168612 | A1 * | 7/2009 | Robin | A44C 5/0053 | 368/282 |
| 2012/0041276 | A1 * | 2/2012 | Doreus | A61B 5/681 | 600/301 |
| 2014/0084033 | A1 * | 3/2014 | Kellond | A44C 5/14 | 224/164 |
| 2016/0037841 | A1 * | 2/2016 | Dey | A44C 27/001 | 2/170 |
| 2016/0282899 | A1 * | 9/2016 | Inagaki | A44C 5/0053 | |
| 2016/0299526 | A1 * | 10/2016 | Inagaki | G06F 3/0443 | |
| 2018/0213895 | A1 * | 8/2018 | Green | A45F 5/00 | |
| 2019/0029373 | A1 * | 1/2019 | Shaffer | A44C 5/2071 | |
| 2019/0128374 | A1 * | 5/2019 | Cruise | A44C 5/0053 | |
| 2020/0367613 | A1 * | 11/2020 | Moustafa | A44C 5/14 | |
| 2021/0298395 | A1 * | 9/2021 | Halpern | A41D 20/00 | |
| 2023/0157425 | A1 * | 5/2023 | Ringenbach | A44C 5/0053 | 63/3 |
| 2024/0074551 | A1 * | 3/2024 | Kim | A44C 5/14 | |

FOREIGN PATENT DOCUMENTS

| | | | | | |
|---|---|---|---|---|---|
| CN | 206964182 | U * | 2/2018 | | |
| CN | 109303388 | A * | 2/2019 | A44B 18/0023 | |
| CN | 208692397 | U * | 4/2019 | A44B 11/18 | |
| CN | 107581726 | B * | 6/2020 | A44C 5/0069 | |
| CN | 112545122 | A * | 3/2021 | A44C 5/0053 | |
| CN | 112545122 | B * | 1/2024 | A44C 5/0053 | |
| DE | 29619751 | | 1/1997 | | |
| DE | 112018003864 | | 4/2020 | | |
| JP | H0870914 | A | 3/1996 | | |
| JP | 2020528794 | A * | 10/2020 | | |
| KR | 10-1946156 | B | 2/2019 | | |
| KR | 101946156 | B1 * | 2/2019 | | |
| WO | WO-0141596 | A2 * | 6/2001 | A44B 18/0023 | |

OTHER PUBLICATIONS

International Search Report and Written Opinion from PCT/CN2022/116491, dated May 15, 2023, 9 pages.

German Patent Application No. 11 2022 001 145.9, English Translation of Examination Report dated Mar. 11, 2026, 7 pages.

* cited by examiner

WATCHBANDS WITH HOOK AND LOOP FASTENERS

CROSS-REFERENCE TO RELATED APPLICATIONS

This application is a continuation of International Patent Application No. PCT/CN2022/116491, entitled "WATCHBANDS WITH HOOK AND LOOP FASTENERS," filed on Sep. 1, 2022, the disclosure of which is hereby incorporated herein in its entirety.

TECHNICAL FIELD

The present description relates generally to securement of wearable devices, and, more particularly, to watchbands with hook and loop fasteners.

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin, and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device can depend on the function and arrangement of the watchband.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
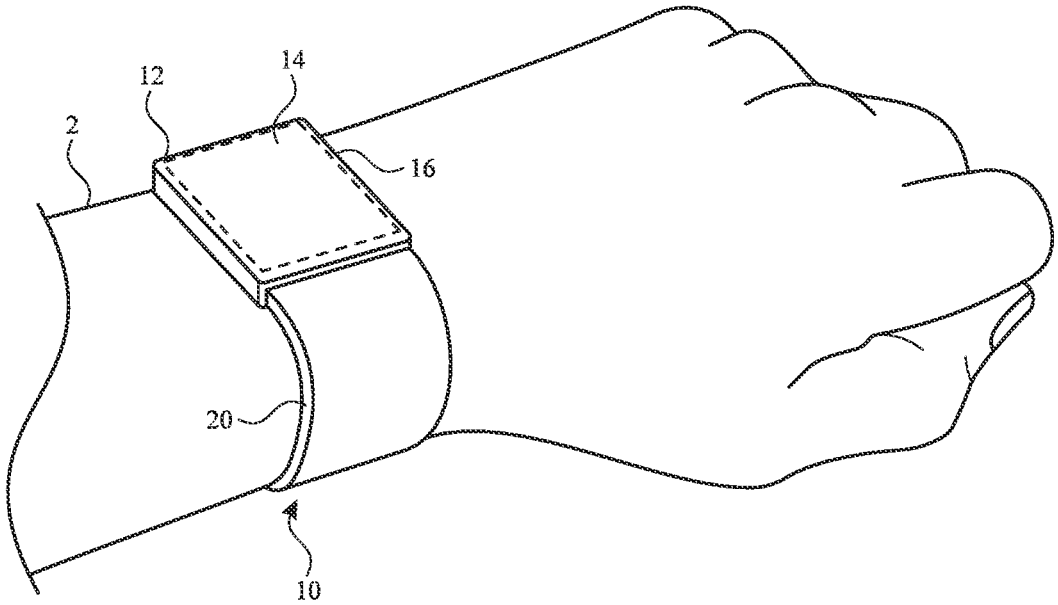
FIG. 1 is a perspective view of a watch on a wrist of a user, in accordance with some embodiments of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form to avoid obscuring the concepts of the subject technology.

An electronic device, such as a wristwatch or fitness/health tracking device, can be attached to a user's wrist by a watchband. It can be desirable to maintain a secure attachment to the wrist so that the electronic device does not shift excessively or slip off the user. Securement of the electronic device against the user can also be important to the function of electronic components, such as biometric sensors. Additionally, it can be desirable to maximize the comfort of the user while wearing the electronic device. Often, a secure attachment can apply an undesirable amount of force on the wrist of the user. In many cases, conventional watchbands may catch, pinch, or pull a user's hair or skin during use if the band is overly tight. In other cases, watchbands may slide along a user's wrist, turn about a user's wrist, or may be otherwise uncomfortable or bothersome to a user if the band is overly loose. These problems can be exacerbated during periods of heightened activity, such as while running or playing sports.

Furthermore, adjusting the size or fit of conventional watchbands often requires multiple steps, specialized tools, and/or technical expertise. Sizing options available to a user may be insufficient to obtain a proper fit. The fit may be different and/or may be perceived to be different given certain environmental (e.g., temperature, humidity) or biological conditions (e.g., sweat, inflammation). As a result, users of conventional wristwatches and/or fitness/health tracking devices may select a tolerable (although not optimally comfortable) fit, reserving tight bands for fitness/health tracking devices and loose bands for conventional wristwatches. However, some wearable electronic devices may be multi-purpose devices, providing both fitness/health tracking and timekeeping functionality. Accordingly, a user may prefer the fit of a watch to vary with use. For example, a user may prefer a looser fit in a timekeeping mode and a tighter fit in a fitness/health tracking mode. Accordingly, there may be a present need for systems and methods for dynamic adjustment of the fit of wearable electronic devices.

Embodiments of the present disclosure provide hook and loop attachment mechanisms. The attachment mechanisms provide secure attachment to a user and provide enhanced comfort. For example, loops can be woven in a pattern to provide engagement with hooks as well as comfortable contact with the user. The loops can be woven in a manner that forms the loops on a contact side of the watchband for contacting the skin of the user and providing moisture wicking or air ventilation. Embodiments of the present disclosure provide ease of adjustment by a user as well as secure attachment to avoid inadvertent release under external forces. Edge sections of the base can wrap around a central section to define an end of the base. A tab can extend from an end of the base to facilitate attachment, adjustment, and/or removal of the watch band. The tab can further help maintain the assembled parts in place to enhance durability of the watchband.

According to some embodiments, for example as shown in FIG. 1, a watch 10 includes a watch body 12 that is worn on a wrist 2 with a watchband 20. Watch body 12 can be portable and attached to other body parts of the user or to other devices, structures, or objects. Watchband 20 can be flexible and encircle at least a portion of wrist 2 of a user. By securing watch body 12 to the person of the user, watchband 20 provides security and convenience. In some embodiments, watch body 12 includes a display 14 and a housing 16 for containing components.

Figure 2:
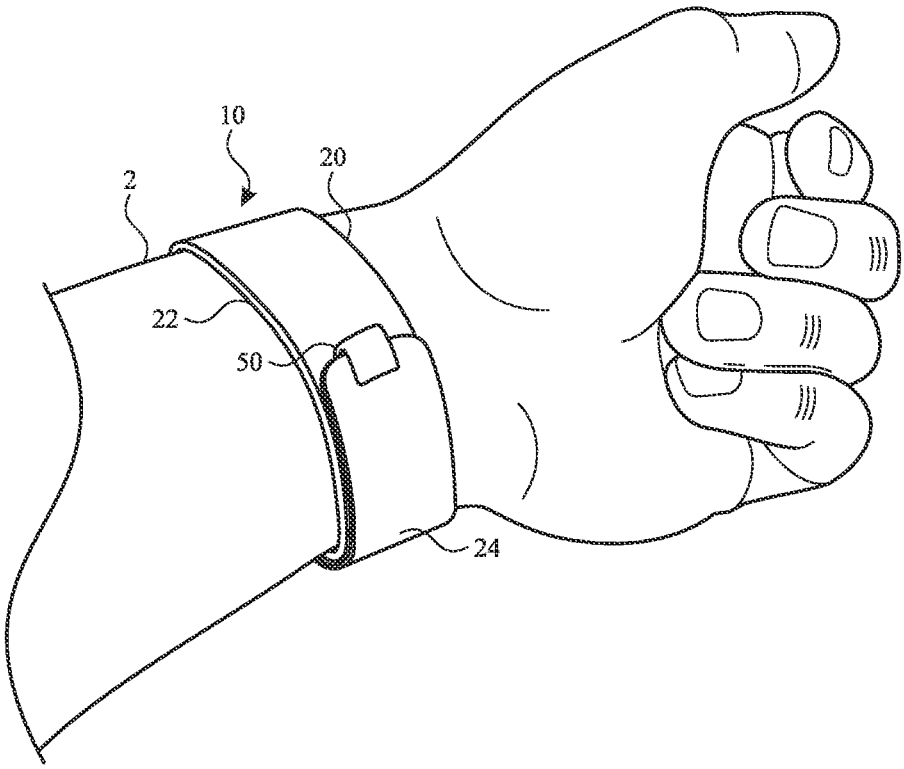
FIG. 2 is another perspective view of the watch of FIG. 1 on the wrist of the user, in accordance with some embodiments of the present disclosure.

According to some embodiments, for example as shown in FIG. 2, watchband 20 extends to an opposite side of wrist 2 of user from watch body 12. Watchband 20 includes an inner portion 22 and an outer portion 24 that overlap and engage each other. Watchband 20 can further include a tab 50 at a free end thereof to facilitate manipulation of watchband 20 during attachment, adjustment, and/or removal thereof. As used herein, a tab 50 can refer to a structure for manipulation by a user and/or to interact with a retaining ring 40 to prevent passage of retaining ring 40 entirely over and past tab 50. It will be understood that tab 50 can refer to a variety of structures to achieve these and/or other objectives. For example, tab 50 can take the form of a keeper, a strap, a stopper, a handle, an anchor, an endpiece, and the like.

Figure 3:
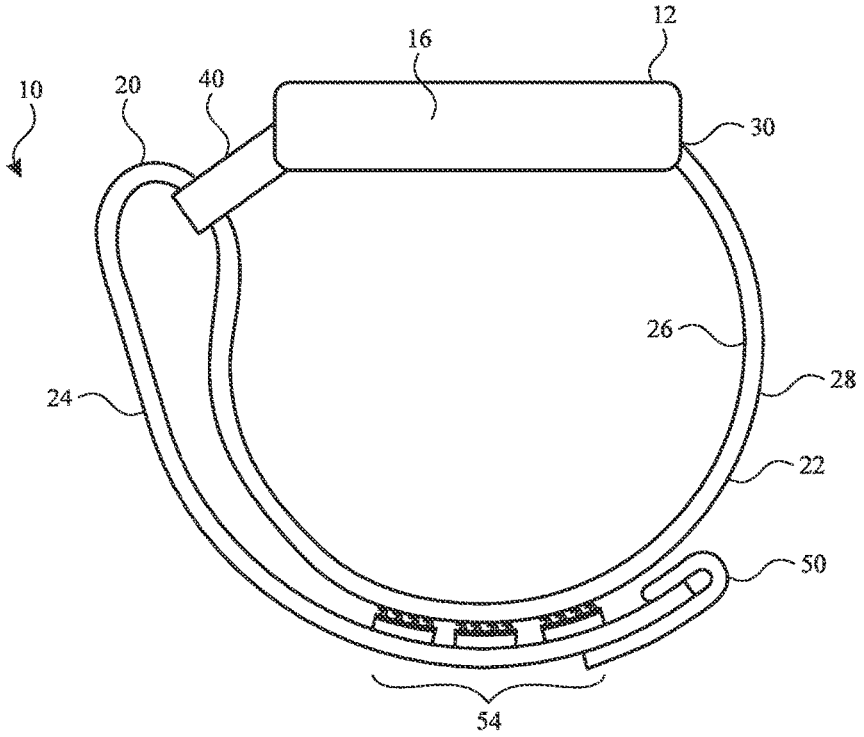
FIG. 3 is a side view of a watch with a watchband, in accordance with some embodiments of the present disclosure.

According to some embodiments, for example as shown in FIG. 3, watchband 20 is adjustable to fit securely and comfortably onto wrist 2 by selecting an extent of overlap between inner portion 22 and outer portion 24. For example, the diameter of watchband 20 is adjustable to be appropriate for a secure and comfortable fit on wrist 2. Watchband 20 removably attaches to a portion of housing 16 of watch body 12 with a housing connector 30. Watchband 20 removably attaches to another portion of housing 16 of watch body 12 with retaining ring 40. Accordingly, watchband 20 is removeable from watch body 12 and replaced, thereby permitting a user to switch watchbands as necessary or desired. A portion of base 32 of watchband 20 passes through a hole of retaining ring 40, such that the length of inner portion 22 and the length of outer portion 24 are defined on either side of retaining ring 40.

A contact surface 26 of watchband 20 is positionable to contact wrist 2 of the user. Along inner portion 22, contact surface 26 faces inwardly toward wrist 2. Along outer portion 24, contact surface 26 continues as an outwardly facing surface. An engagement surface 28 of watchband 20 is positionable to contact itself. Along inner portion 22, engagement surface 28 faces outwardly away from wrist 2. Along outer portion 24, engagement surface 28 faces inwardly toward inner portion 22 and opposite the portion of engagement surface 28 that extends along inner portion 22. A hook zone 54 is provided on engagement surface 28 and along outer portion 24. Hook zone 54 is arranged to engage loops of a loop zone 52 on engagement surface 28 and along inner portion 22, as described further herein. Engagement surface 28 can be arranged to avoid contact with wrist 2 of the user.

Figure 4:
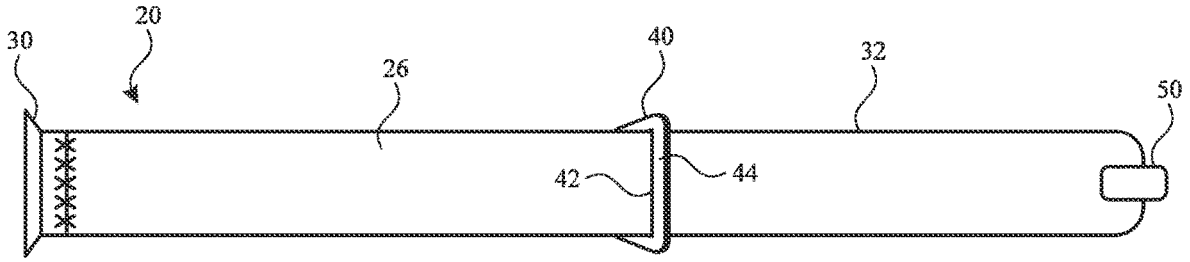
FIG. 4 is a top view of a watchband, in accordance with some embodiments of the present disclosure.

According to some embodiments, for example as shown in FIG. 4, housing connector 30 and a tab 50 are located at or near ends of watchband 20. Retaining ring 40 is slidably connected to a base 32 of watchband 20 and provides a connection to housing 16 of watch body 12. Contact surface 26 extends between housing connector 30 and tab 50. For example, contact surface 26 extends to housing connector 30 and/or tab 50. Contact surface 26 provides loops extending from base 32 for contacting wrist 2 along inner portion 22 and for providing an outwardly facing surface along outer portion 24.

As shown in FIG. 4, retaining ring 40 can have an engagement end 44 and a retaining ring hole 42 through which watchband 20 can extend. Tab 50 has at least one cross-sectional dimension that is larger than at least one cross-sectional dimension of retaining ring hole 42. For example, tab 50 can have a cross-sectional dimension (e.g., thickness), transverse to a longitudinal axis of watchband 20, that is larger than a cross-sectional dimension (e.g., thickness) of retaining ring hole 42. Retaining ring 40 further includes an engagement member for secure engagement with housing 16 of watch body 12. For example, the engagement member allows retaining ring 40 to securely engage housing 16 within a channel thereof. The engagement member can be the same as, similar to, or different from an engagement member of housing connector 30.

Figure 5:
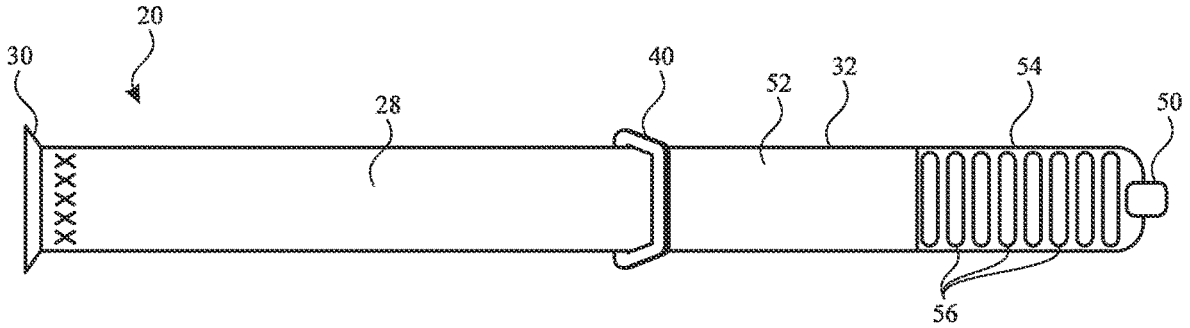
FIG. 5 is a bottom view of the watchband of FIG. 4, in accordance with some embodiments of the present disclosure.

According to some embodiments, for example as shown in FIG. 5, engagement surface 28 extends between housing connector 30 and tab 50. Engagement surface 28 includes loop zone 52 and hook zone 54. Loop zone 52 can extend closer to housing connector 30, and hook zone 54 can extend closer to tab 50. Along loop zone 52, engagement surface 28 provides loops extending from base 32 for engagement with hooks of hook zone 54. Hook zone 54 can include one or more hook pads 56 attached to base 32 and for engagement with the loops of loop zone 52.

As shown in FIGS. 4 and 5, the portion of contact surface 26 having loops can have a greater area than the area of loop zone 52 of engagement surface 28. For example, contact surface 26 can have loops along an entire length thereof between housing connector 30 and tab 50. Engagement surface 28 can be divided between loop zone 52 and hook zone 54.

According to some embodiments, for example as shown in FIG. 5, multiple hook pads 56 are provided along a hook zone 54 of a watchband 20. Hook zone 54 is adjacent to a loop zone 52 of watchband 20. Hook zone 54 provides a length of base 32 without loops extending therefrom. Hook zone 54 can be adjacent to tab 50. Each of hook pads 56 is longitudinally spaced apart from one or longitudinally adjacent hook pads 56. The interruptions between hook pads 56 provide greater flexibility than would be provided with a continuous length of one or more hook pads 56. Accordingly, hook zone 54 has an overall greater flexibility with the interruptions. One or more hook pads 56 at or near a terminal end of watchband 20 can provide enhanced engagement. For example, an endmost one of hook pads 56 can be larger than other hook pads 56 located within hook zone 54 at greater distances from tab 50. Other features can be provided, such as a different number, density, distribution, size, and/or shape of hooks on one or more hook pads 56 at or near a terminal end of watchband 20 as compared to the other hook pads 56. The distinct features of the endmost hook pad 56 can provide stronger engagement near the terminal end of watchband 20 to resist forces that would disengage watchband 20 from itself. A greater number of hook pads 56 with small interruptions can also provide flexibility, with a greater surface area of hook zone 54 being occupied by hook pads 56. The number, density, size, and/or shape of hook pads 56 can be consistent or vary across the surface of hook zone 54. Hook pads 56 can be attached to base 32 by one or more of welding (e.g., laser welding), lamination, adhesion, interweaving, or combinations thereof.

Figure 6:
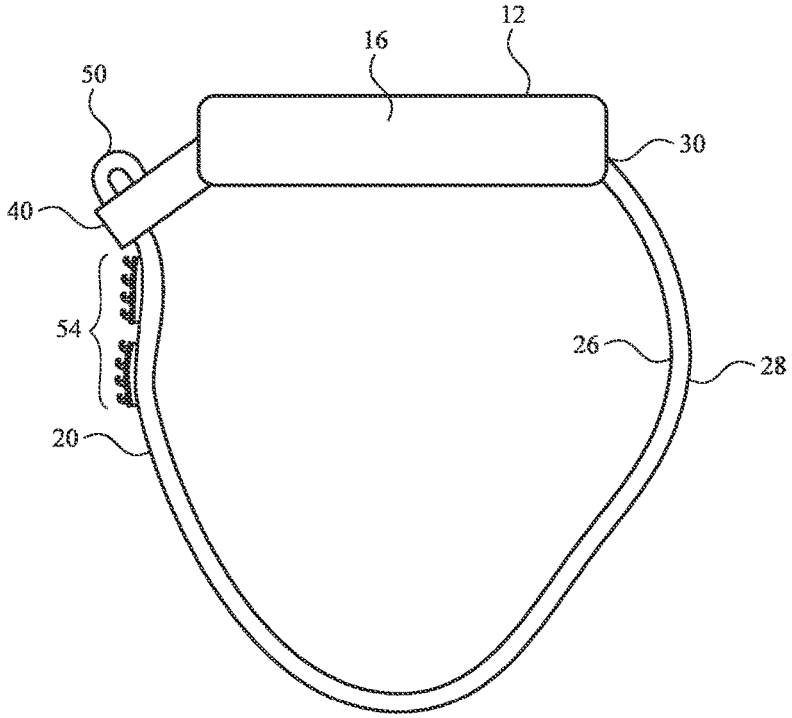
FIG. 6 is a side view of a watch with a watchband, in accordance with some embodiments of the present disclosure.

According to some embodiments, for example as shown in FIG. 6, watchband 20 slidably extends through retaining ring 40. The length of watchband 20 that extends on either side of retaining ring 40 can be adjusted as desired by a user for preferred comfort and grip on wrist 2 of the user. A tab 50 can be sized and arranged to prevent passage through retaining ring 40 so that a portion of watchband 20 remains within at least a portion of retaining ring 40. Tab 50 can include features on engagement surface 28 and/or contact surface 26, such as coupling features.

Figure 7:
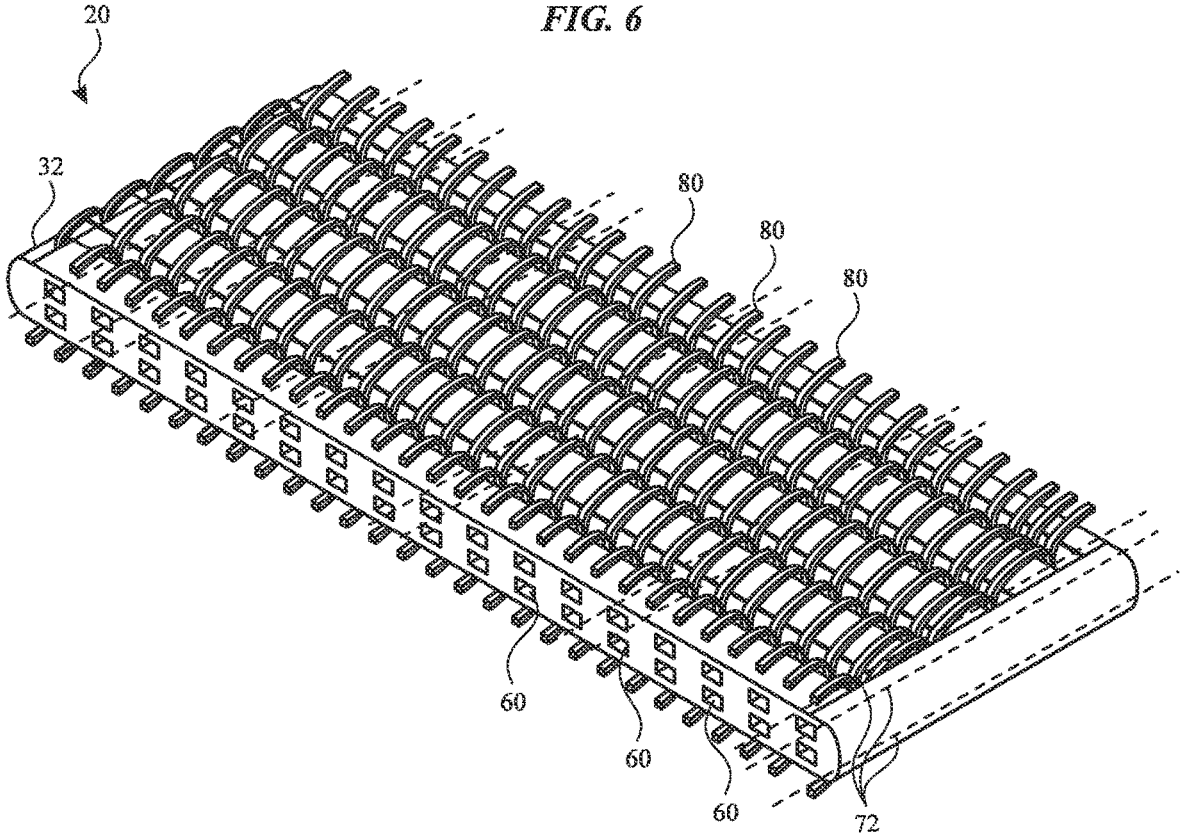
FIG. 7 is a perspective sectional view of a portion of a watchband, in accordance with some embodiments of the present disclosure.

According to some embodiments, for example as shown in FIG. 7, watchband 20 includes loops 80 above base 32. Loops 80 can be formed by loop threads that extend from and return to base 32. Each of the loop threads can be woven into base 32 and extend onto or beyond contact surface 26 and engagement surface 28. Base 32 can be formed from base threads 60 and/or elastic threads 72. Elastic threads 72 extend longitudinally, for example toward housing connector 30 and tab 50. Base threads 60 extend transverse to elastic threads 72 and/or the loop threads. Elastic threads 72 turn and reverse direction at one or more ends of base 32.

As used herein, a loop is defined by a length of a structure that surrounds a closed space. A loop can be formed by a thread even when the thread does not connect to itself to surround the closed space. For example, a "loop" of thread can extend from a base and return to the base, such that the thread and the base together surround a closed space.

Materials selected for the threads can be selected to facilitate the manufacture and use described herein. The threads can include natural and/or synthetic fibers. The threads can include a polymer, copolymer, or polymer blend. The threads can include nylon, polyester, polyurethane, and combinations thereof, including spandex. The threads can include single filaments and/or a bundle of yarn. Elastic threads 72 can be of a material that facilitates stretching. Base threads 60 and the loop threads can be of the same or a similar material. Base threads 60 can have a melting point that is lower than a melting point of the loop threads.

Figure 8:
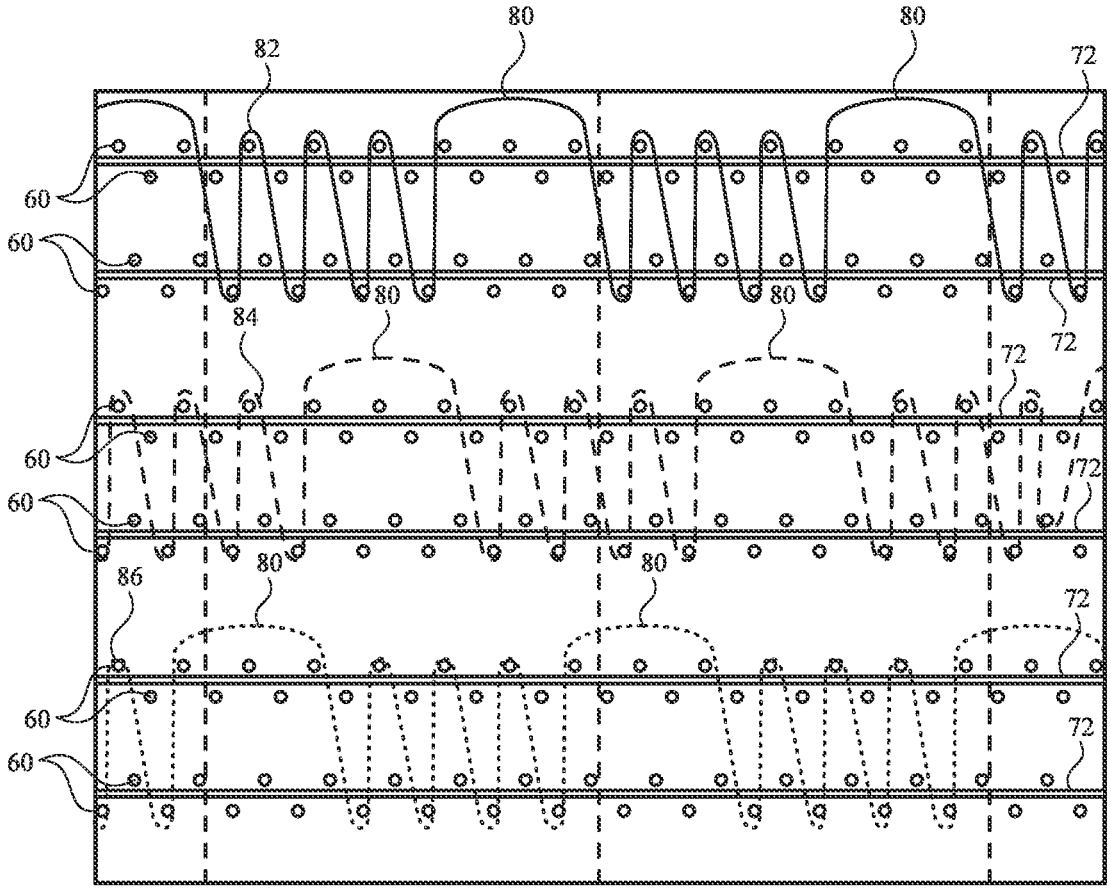
FIG. 8 is a sectional view showing a weave pattern, in accordance with some embodiments of the present disclosure.

According to some embodiments, for example as shown in FIG. 8, one or more engagement loop threads are used to form engagement loops 80 on engagement surface 28. Engagement loops 80 are formed and arranged to enhance engagement with hooks. For example, the shape, size, number, and distribution of engagement loops 80 can facilitate ready and secure engagement with hooks. Such features are provided with a weave by which engagement loops 80 are formed.

As further shown in FIG. 8, first engagement loop threads 82, second engagement loop threads 84, and third engagement loop threads 86 are woven into the same base 32. First engagement loop threads 82, second engagement loop threads 84, and third engagement loop threads 86 are separate threads or segments of one or more continuous threads. At least some segments of the engagement loop threads, including engagement loops 80, extend in parallel to each other along base 32.

As further shown in FIG. 8, a first engagement loop thread 82 forms an engagement loop 80 extending away from engagement surface 28 of base 32 and along a longitudinal length. The longitudinal length of engagement loop 80 corresponds to a number of base threads 60 between the locations at which engagement loop 80 extends from base 32. For example, as shown in FIG. 8, engagement loops 80 extend longitudinally across five base threads 60 (i.e., referring to a combined number of base threads 60 on opposite surfaces of base 32). Other longitudinal lengths and numbers of skipped base threads 60 can apply to characterize engagement loop 80, as described further herein. For example, an engagement loop thread can form an engagement loop 80 that extends across 3, 4, 5, 6, 7, 8, 9, 10, or more than 10 base threads 60.

Between each engagement loop 80, first engagement loop thread 82 extends alternatingly between and/or beyond opposing surfaces (i.e., contact surface 26 and engagement surface 28) of base 32. At each of the surfaces, first engagement loop thread 82 extends at least partially about a base thread 60 and turn to reenter base 32. First engagement loop thread 82 turns and returns to base 32 without forming an engagement loop 80 or extending longitudinally in a manner that skips any base threads 60. In such an arrangement, the turn of first engagement loop thread 82 is against base 32, rather than elevated away from base 32 as an engagement loop 80. The extent of first engagement loop thread 82 between adjacent engagement loops 80 corresponds to a number of consecutive base threads 60 about which first engagement loop thread 82 turns. For example, as shown in FIG. 8, first engagement loop thread 82 can turn about seven consecutive base threads 60 between adjacent engagement loops 80. Other numbers of contacted base threads 60 can apply to characterize first engagement loop thread 82, as described further herein. For example, an engagement loop thread can turn about 2, 3, 4, 5, 6, 7, 8, 9, 10, 11, 12, 13, 14, or more than 14 consecutive base threads 60 between adjacent engagement loops 80.

As further shown in FIG. 8, different threads are staggered, such that engagement loops 80 of one thread are formed at different longitudinal locations than engagement loops 80 of another thread. For example, engagement loops 80 of first engagement loop thread 82 can be formed at a longitudinal location that is different from the location of engagement loops 80 formed by second engagement loop thread 84. Furthermore, engagement loops 80 of third engagement loop thread 86 can be formed at a longitudinal location that is different from the location of engagement loops 80 formed by first engagement loop thread 82 and the location of engagement loops 80 formed by second engagement loop thread 84. Such an arrangement allows engagement loops 80 to be distributed farther away from each other, so that greater opportunities for engagement with hooks are provided. Accordingly, engagement loops 80 of one thread extend across a set of base threads 60 that is different than the set of base threads 60 across which engagement loops 80 of another thread extend. Additionally, engagement loops 80 of one thread turn about a set of consecutive base threads 60 that is different than the set of consecutive base threads 60 about which another thread turns.

Figure 9:
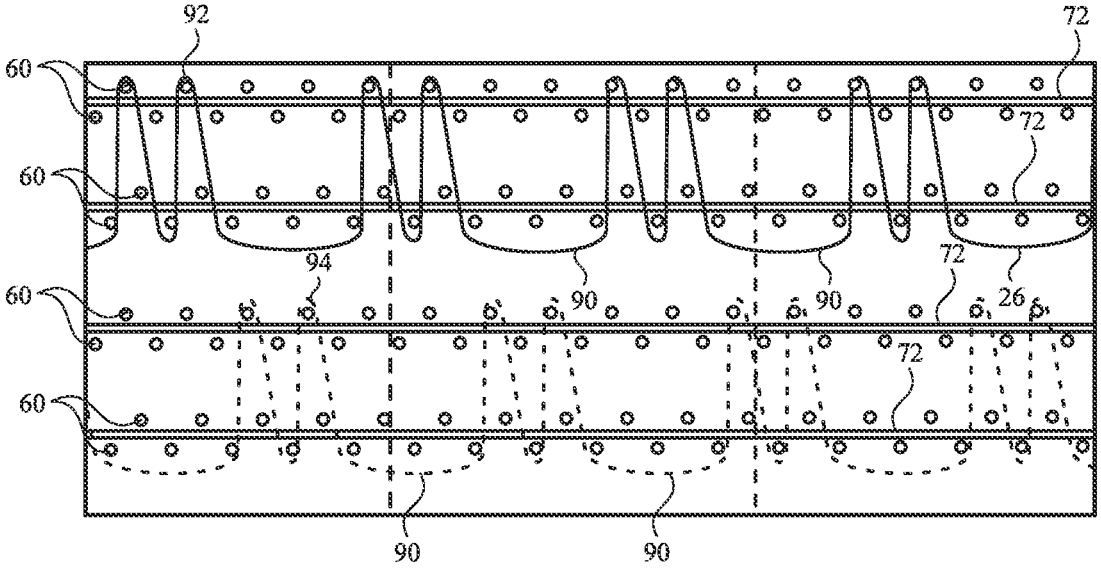
FIG. 9 is a sectional view showing a weave pattern, in accordance with some embodiments of the present disclosure.

According to some embodiments, for example as shown in FIG. 9, one or more contact loop threads are used to form contact loops 90 on contact surface 26. Contact loops 90 are formed and arranged to enhance contact with wrist 2 of the user. For example, the shape, size, number, and distribution of contact loops 90 facilitate comfort, breathability, and moisture wicking capabilities for the user. Such features can be provided with a weave by which contact loops 90 are formed. As shown in FIG. 9, first contact loop threads 92 and second contact loop threads 94 can be woven into the same base 32. First contact loop threads 92 and second contact loop threads 94 can be separate threads or segments of one or more continuous threads. At least some segments of the contact loop threads, including contact loops 90, extend in parallel to each other along base 32. As further shown in FIG. 9, a first contact loop thread 92 forms a contact loop 90 extending away from contact surface 26 of base 32 and along a longitudinal length. The longitudinal length of contact loop 90 corresponds to a number of base threads 60 between the locations at which contact loop 90 extends from base 32. For example, as shown in FIG. 8, contact loops 90 extend longitudinally across five base threads 60 (i.e., referring to a combined number of base threads 60 on opposite surfaces of base 32). Other longitudinal lengths and numbers of skipped base threads 60 can apply to characterize contact loop 90, as described further herein. For example, a contact loop thread can form a contact loop 90 that extends across 3, 4, 5, 6, 7, 8, 9, 10, or more than 10 base threads 60.

The longitudinal length of one or more of engagement loops 80 can be the same or different than the longitudinal length of one or more of contact loops 90. For example, the lengths can be uniform for both engagement loops 80 on engagement surface 28 and contact loops 90 on contact surface 26. Alternatively or in combination, the loops can have different sizes to accommodate the different functions of contacting the user and engaging hooks.

Between each contact loop 90, first contact loop thread 92 extends alternatingly between and/or beyond opposing surfaces (i.e., contact surface 26 and engagement surface 28) of base 32. At each of the surfaces, first contact loop thread 92 extends at least partially about a base thread 60 and turn to reenter base 32. First contact loop thread 92 turns and returns to base 32 without forming a contact loop 90 or extending longitudinally in a manner that skips any base threads 60. In such an arrangement, the turn of first contact loop thread 92 is against base 32, rather than elevated away from base 32 as a contact loop 90. The extent of first contact loop thread 92 between adjacent contact loops 90 corresponds to a number of consecutive base threads 60 about which first contact loop thread 92 turns. For example, as shown in FIG. 9, first contact loop thread 92 turn about 3 consecutive base threads 60 between adjacent contact loops 90. Other numbers of contacted base threads 60 can apply to characterize first contact loop thread 92, as described further herein. For example, a contact loop thread can turn about 2, 3, 4, 5, 6, 7, 8, or more than 8 consecutive base threads 60 between adjacent engagement loops 80.

The number of turns between adjacent engagement loops 80 can be the same or different than the number of turns between adjacent contact loops 90. For example, the number of turns can be different to accommodate the different functions of contacting the user and engaging hooks. The number of turns between adjacent engagement loops 80 can be greater than the number of turns between adjacent contact loops 90, so that engagement loops 80 remain more securely fixed throughout multiple hook engagement and disengagement actions. A lower number of turns between adjacent contact loops 90 can also yield a greater density of contact loops 90 in a given area of base 32. For example, where engagement loops 80 and contact loops 90 have the same or substantially equal lengths, the lower number of turns between adjacent contact loops 90 produces a greater number of contact loops 90 than engagement loops 80 in a given area. The higher density of contact loops 90 provides greater comfort for the user by distributing forces across the greater number of contact loops 90.

As shown in FIG. 9, different threads can be staggered, such that contact loops 90 of one thread are formed at different longitudinal locations than contact loops 90 of another thread. For example, contact loops 90 of first contact loop thread 92 can be formed at a longitudinal location that is different from the location of contact loops 90 formed by the second contact loop thread 94. Such an arrangement allows contact loops 90 to be distributed farther away from each other, so that forces and pressure on wrist 2 of the user is more evenly distributed. Accordingly, one thread can extend across a set of base threads 60 that is different than the set of base threads 60 across which contact loops 90 of another thread extend. Additionally, one thread can turn about a set of consecutive base threads 60 that is different than the set of consecutive base threads 60 about which another thread turns.

According to some embodiments, engagement loops 80 and contact loops 90 are formed and secured by a weaving process. Base 32 can be stretched longitudinally to increase the longitudinal spacing between base threads 60. Elastic threads 72, extending longitudinally, can facilitate the stretching based on elastic properties of elastic threads 72. The loop threads can be woven into base 32 as described herein while base 32 is in the stretched configuration. When base 32 returns to a non-stretched or relaxed configuration, engagement loops 80 and contact loops 90 become elevated from base 32 due to the shortening between the locations at which engagement loops 80 and contact loops 90 extend from base 32. The loop threads and base 32 can be heated, such that at least base threads 60 at least partially melt to fuse and bond to the loop threads that contact and turn about base threads 60. Thus, a secure engagement between the loop threads and base threads 60 is achieved. The strength of the bond can be proportionate to the number of turns made by the loop threads about base threads 60.

The watchband can be made in a variety of colors with visual effects that occur based on the design described herein. At least some of the contact loop threads, the engagement loop threads, the contact base threads, and the engagement base threads can be of different colors that other threads in watchband 20. The several threads can be combined to produce custom color combinations as desired. The colors can be selected based on the appearance of certain threads in the weaving patterns described herein. Furthermore, because portions of the threads are elevated away from a surface, the weaving pattern produces different visual effects when viewed at different angles. For example, at some viewing angles, rows of the loops present themselves visually while blocking views of many of the base threads. At these angles, the color selected for the loop threads is relatively more prominent. At other viewing angles, the base threads are viewed more easily. At these angles, the color selected for the base threads is relatively more prominent. As such, the apparent color, pattern, and design changes as watchband 20 is viewed from different angles.

Figure 10:
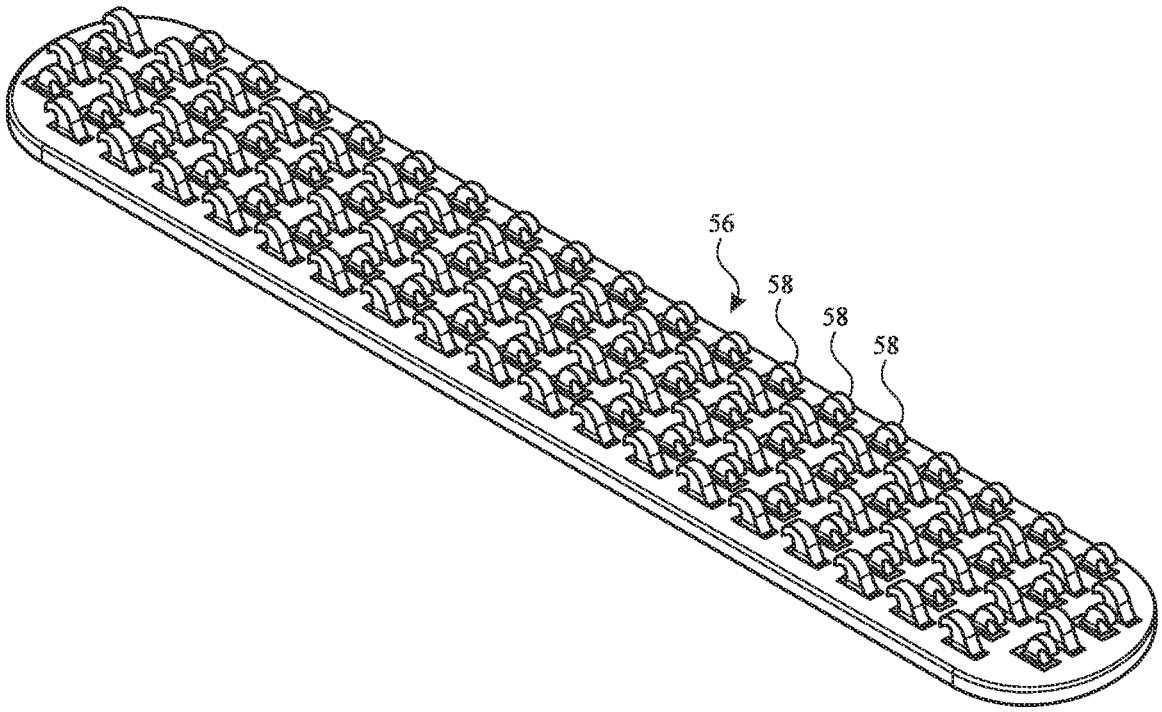
FIG. 10 is a perspective view of a hook pad, in accordance with some embodiments of the present disclosure.

According to some embodiments, for example as shown in FIG. 10, a hook pad 56 can include one or more hooks 58 for engagement with loops. Hooks 58 can be distributed across a surface of hook pad 56. The number, density, size, and/or shape of hooks 58 can be consistent or vary across the surface of hook pad 56. The perimeter of hook pad 56 can include one or more curves to reduce sharpness of the edges.

Figure 11:
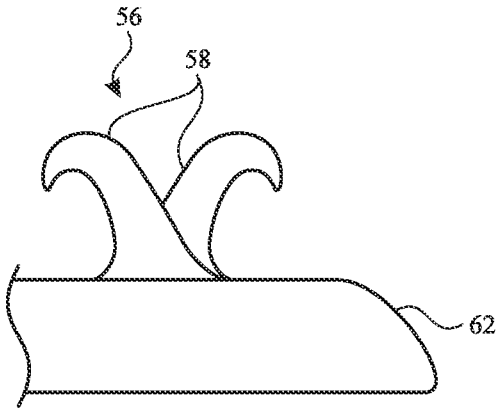
FIG. 11 is a side view of a hook pad, in accordance with some embodiments of the present disclosure.

According to some embodiments, for example as shown in FIG. 11, a hook pad 56 includes a transition from a top surface to a bottom surface that reduces sharp edges. For example, hook pad 56 can include an edge region 62 along a periphery of hook pad 56. Edge region 62 can include one or surface features that provide a transition. For example, as shown in FIG. 11, hook pad 56 can include a round bevel. Other shapes and geometries can be provided.

Figure 12:
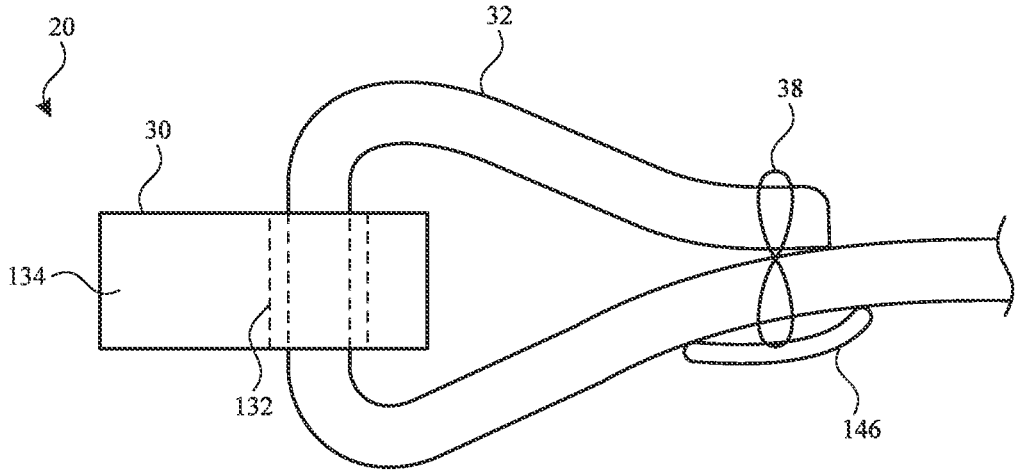
FIG. 12 is a side view of a portion of a watchband, in accordance with some embodiments of the present disclosure.

Referring now to FIG. 12, an end of the watchband can provide a connector for engaging a watch body. According to some embodiments, for example as shown in FIG. 12, base 32 of watchband 20 can include housing connector 30. Housing connector 30 can include an engagement end 134 for removably attaching to a portion of the housing of the watch body. Housing connector 30 can further include a connector hole 132 through which base 32 of watchband 20 can extend. For example, a portion of base 32 passes through connector hole 132 of housing connector 30, such that a portion of base 32 overlaps itself. The overlapping portions of base 32 can be affixed to each other, so that base 32 is not removed from connector hole 132 and released from housing connector 30. For example, the overlapping portions of base 32 can be secured to each other with a stitch 38 that extends at least partially through each of the overlapping portions. Optionally, stitch 38 can extend to exterior surfaces of one or more of the overlapping portions of base 32. In some embodiments, stitch 38 can extend to a terminal end of at least one of the overlapping portions. In some embodiments, watchband 20 can include a tag 146 that covers at least a portion of stitch 38. In some embodiments, the overlapping portions of base 32 can be affixed to each other by one or more of a variety of mechanisms. For example, an adhesive can bond the overlapping portions of base 32 to each other. By further example, the material of base 32 itself can be bonded (e.g., melted) to itself along the overlapping portions.

Referring now to FIGS. 13-16, a free end of a watchband can be formed of woven material that is manipulated and/or assembled to provide a secure structure at the end thereof. For example, while the watchband can include woven fabric, as described herein, the end portions of the woven material can be assembled such that the fabric components are secured to each other without any loose ends, thereby maintaining their woven structure during use of the watchband.

Figure 13:
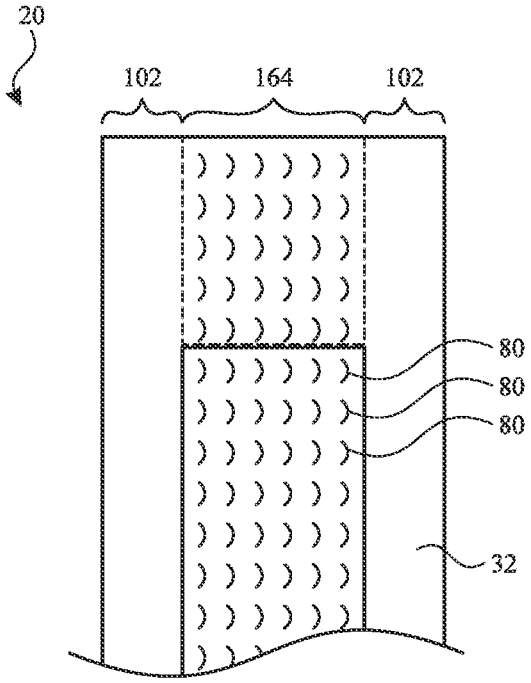
FIG. 13 is a top view of a portion of a watchband in a first state of assembly, in accordance with some embodiments of the present disclosure.

As shown in FIG. 13, a watchband 20 can include multiple sections along the length thereof. For example, base 32 can define, at least in part, a central section 164 that extends longitudinally along the length of watchband 20. Central section 164 can include one or more loops 80 extending therefrom, as described herein for example with respect to the hook zone of the watchband. Base 32 can further define, at least in part, one or more edge sections 102 that each extend longitudinally along the lens of watchband 20. Each of edge sections 102 can define a peripheral edge of watchband 20. Whereas central section 164 can include loops 80 extending from base 32, edge sections 102 can optionally omit such loops. As such, base 32 can entirely define each of edge sections 102. It will be understood that edge sections 102 can be interwoven with central section 164, as described herein. For example, one or more base threads can extend through each of central section 164 and the adjacent edge sections 102. By further example, other threads, such as elastic threads, can extend longitudinally, such that each thread or longitudinally extending length thereof can be confined to only an edge section 102 or a central section 164. As base 32 or the sections thereof can define a terminal end of watchband 20, it can be desirable to provide a terminal end that does not expose loose ends of the threads forming watchband 20. For example, in the assembly state depicted in FIG. 13, central section 164 and edge sections 102 can be formed with the terminal ends thereof by cutting or otherwise ending the woven structure. This can leave loose ends that are susceptible to unravelling unless further treated. Accordingly, an assembly described herein can provide formation of a terminal end formed by lateral edges of edge sections 102, rather than by cut ends of central section 164.

Figure 14:
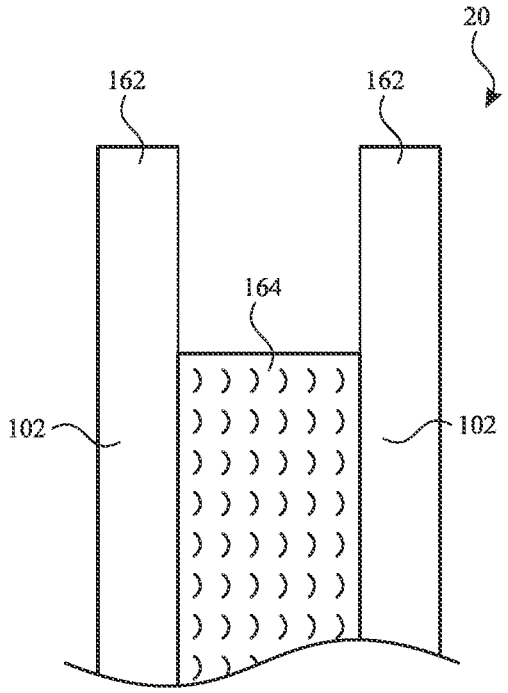
FIG. 14 is a top view of the portion of the watchband of FIG. 13 in a second state of assembly, in accordance with some embodiments of the present disclosure.

As shown in FIG. 14, a portion of central section 164 can be removed such that end portions 162 of edge sections 102 are isolated such that they extend beyond the new terminal end of central section 164. While the terminal ends of edge sections 102 and the new terminal end of central section 164 can leave exposed threads with loose ends, these sections can be shaped to contain such threads.

Figure 15:
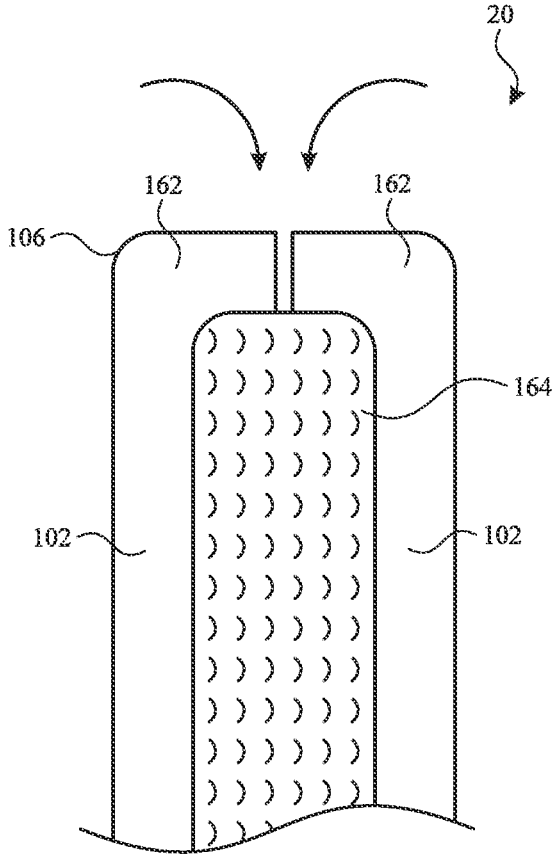
FIG. 15 is a top view of the portion of the watchband of FIGS. 13 and 14 in a third state of assembly, in accordance with some embodiments of the present disclosure.

As shown in FIG. 15, each of end portions 162 of edge sections 102 can be turned about the newly formed terminal end of central section 164. The woven structure of base 32, including edge sections 102, can facilitate such bending to allow the threads thereof to curve around the terminal end of central section 164. For example, longitudinally extending threads (e.g., elastic threads) of edge sections 102 can turn at end portions 162 to extend laterally inwardly towards each other. Accordingly, such threads can extend longitudinally alongside central section 164 and then bend to extend laterally inwardly towards each other beyond the terminal end of central section 164. In such a configuration, the outer peripheral edges defined by edge sections 102 can extend continually with its woven structure both longitudinally (i.e., alongside central section 164) and laterally (i.e., beyond the terminal end of central section 164). As such, the outer peripheral edges defined by edge sections 102 define the new free end 106 of base 32 of watchband 20.

Figure 16:
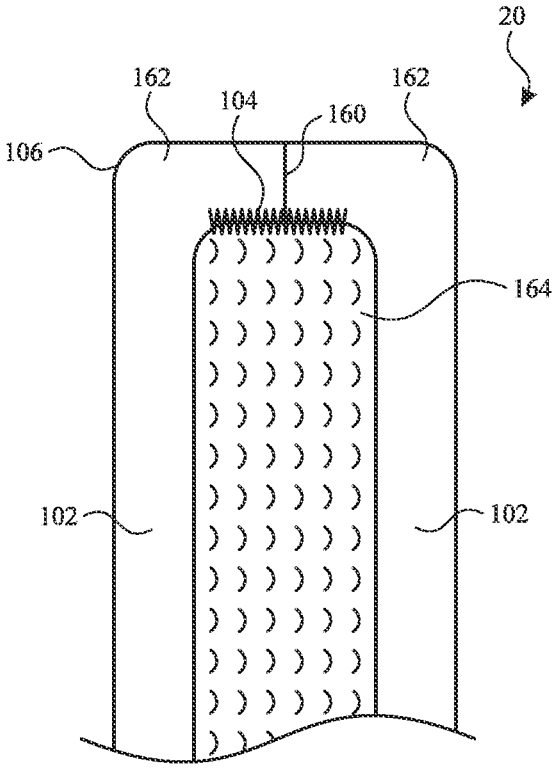
FIG. 16 is a top view of the portion of the watchband of FIGS. 13-15 in a fourth state of assembly, in accordance with some embodiments of the present disclosure.

As shown in FIG. 16, end portions 162 of edge sections 102 can be affixed to central section 164 and to each other. For example, edge sections 102 and/or central section 164 can form one or more interfaces 160 at which the corresponding structures can be joined together. It will be understood that the corresponding structures at such interfaces 160 are not interwoven with each other through interfaces 160, even while it will also be understood that such sections are interwoven with each other at other locations (e.g., edge sections 102 to being interwoven with central section 164 where they extend longitudinally alongside each other in parallel). For example, end portions 162 of edge sections 102 can be secured to each other and/or central section 164 with an interface stitch 104 that extends at least partially through each of the corresponding structures. Optionally, interface stitch 104 can extend to exterior surfaces of one or more of edge sections 102 and/or central section 164. In some embodiments, interface stitch 104 can extend to free end 106. In some embodiments, end portions 162 of edge sections 102 can be secured to each other and/or central section 164 by one or more of a variety of mechanisms. For example, an adhesive can bond the corresponding structures to each other. Such an adhesive can be within interface 160 and/or placed over interface 160 (e.g., overmolded). By further example, the material of base 32 itself can be bonded (e.g., melted) to itself along the corresponding structures. Accordingly, free end 106 of watchband 20 can be defined by the interwoven structure of end portions 162 of edge sections 102, while any previously exposed loose ends are secured within interface 160 by the corresponding support structure(s). Further, end portions 162 of edge sections 102, while not necessarily interwoven across interface 160, can be secured to each other while their outer peripheral edges are aligned to define a continuous free end 106.

Referring now to FIGS. 17-25, a watchband can be provided with a tab at an end thereof to facilitate operation by a user and to protect the assembled components.

Figure 17:
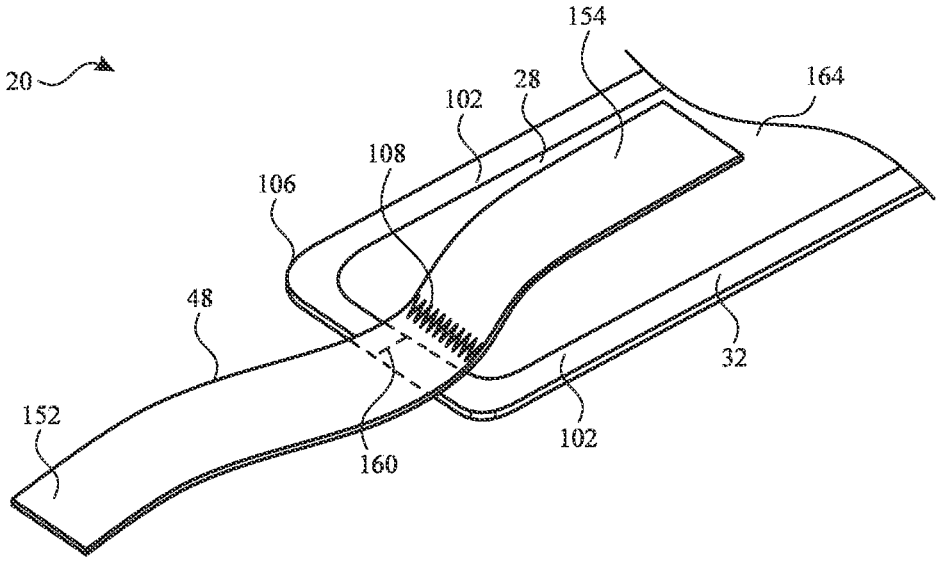
FIG. 17 is a perspective view of the portion of the watchband of FIGS. 13-16 in a fifth state of assembly, in accordance with some embodiments of the present disclosure.

As shown in FIG. 17, a free end 106 of watchband 20 can be formed by joining edge sections 102 together with one or more interfaces 160. At or near the same free end 106, a strap 48 of a tab can be affixed to base 32. For example, an inner stitch 108 can be applied to secure strap 48 to base 32. For example, inner stitch 108 can extend at least partially through strap 48 and base 32 (i.e., through engagement surface 28). Additionally or alternatively, strap 48 and base 32 can be secured to each other by one or more of a variety of mechanisms, including adhesive, overmolding, bonding, fusing, and the like. In some embodiments, inner stitch 108 can be provided between a strap inner segment 152 and a strap outer segment 154. It will be understood that strap 48 can be a continuous material, such as a woven fabric material, and that inner stitch 108 merely defines strap inner segment 152 and strap outer segment 154 as segments of the continuous structure.

Figure 18:
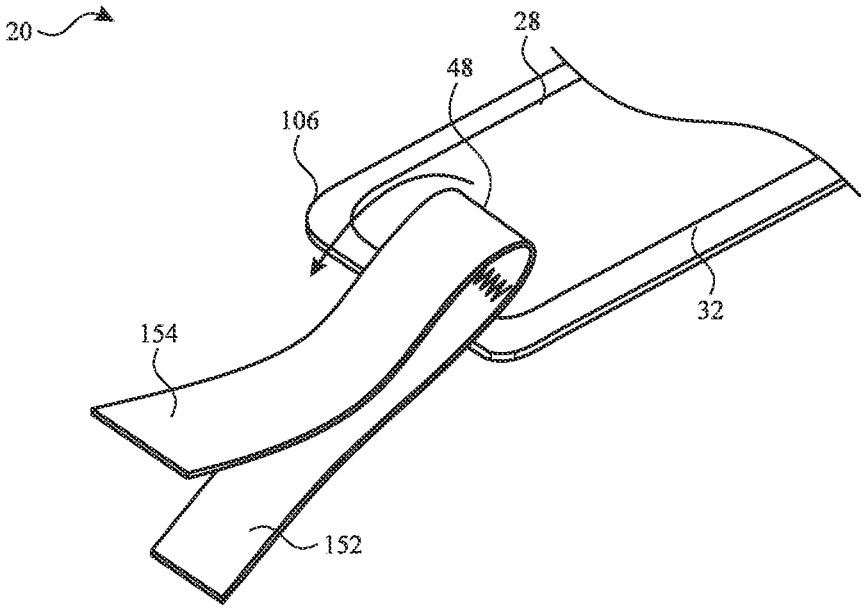
FIG. 18 is a perspective view of the portion of the watchband of FIGS. 13-17 in a sixth state of assembly, in accordance with some embodiments of the present disclosure.
Figure 19:
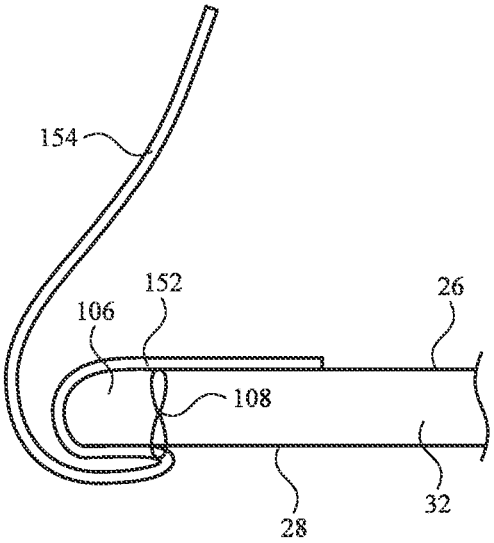
FIG. 19 is a side sectional view of the portion of the watchband of FIGS. 13-18 in a seventh state of assembly, in accordance with some embodiments of the present disclosure.

As shown in FIGS. 18 and 19, strap inner segment 152 and strap outer segment 154 can extend from engagement surface 28 of base 32 and around free end 106. For example, strap inner segment 152 and strap outer segment 154 can each extend from inner stitch 108 toward free end 106 and along engagement surface 28 of base 32. As such, inner stitch 108 can be hidden from view. At free end 106, strap inner segment 152 and strap outer segment 154 can each wrap around free end 106 of base 32 and toward contact surface 26 of base 32. As shown in FIG. 19, strap inner segment 152 can abut engagement surface 28, free end 106, and contact surface 26 of base 32. For example, strap inner segment 152 can be affixed to such portions of base 32, for example, by adhesive, overmolding, bonding, fusing, and the like. Optionally, an additional stitch can be provided. However, strap inner segment 152 can be subjected to less force than strap outer segment 154 when in use, so a less robust connection can be applied.

Figure 20:
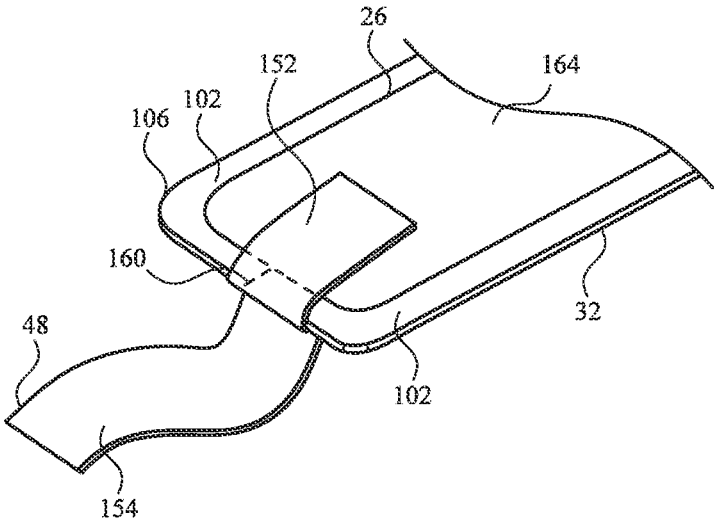
FIG. 20 is a perspective view of the portion of the watchband of FIGS. 13-19 in the seventh state of assembly, in accordance with some embodiments of the present disclosure.

As shown in FIG. 20, strap inner segment 152 can directly contact edge sections 102 and/or central section 164 at least at interface 160 therebetween. As such, the direct application of strap inner segment 152 can reinforce the coupling of edge sections 102 to each other and/or to central section 164.

Figure 21:
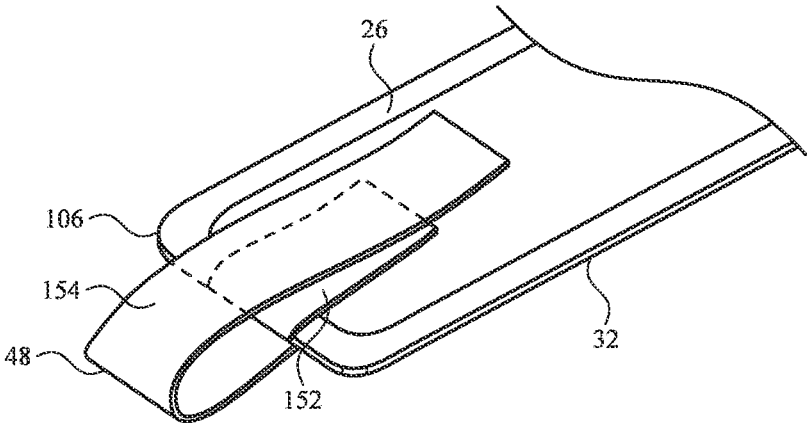
FIG. 21 is a perspective view of the portion of the watchband of FIGS. 13-20 in an eight state of assembly, in accordance with some embodiments of the present disclosure.

As shown in FIG. 21, strap outer segment 154 can also extend about free end 106 of base 32. Whereas strap inner segment 152 can abut base 32, strap outer segment 154 can extend a distance away from base 32 to provide a protruding extension for manipulation by a user. As such, a longitudinal gap can be defined between strap inner segment 152 and strap outer segment 154 as strap outer segment 154 extends a greater distance away from free end 106 of base 32 than does strap inner segment 152.

Figure 22:
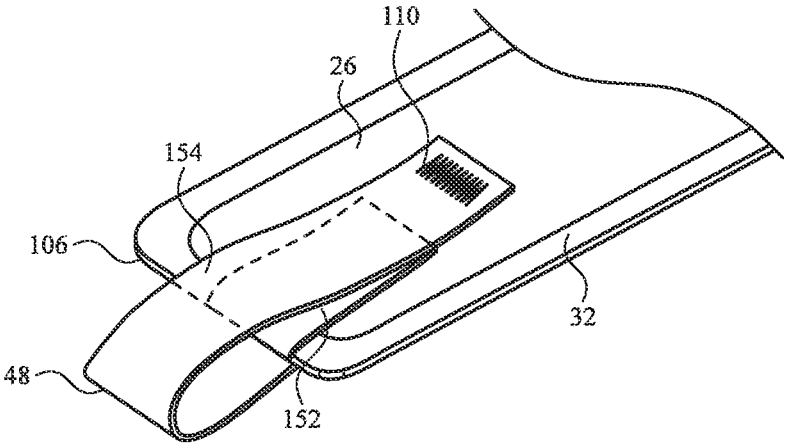
FIG. 22 is a perspective view of the portion of the watchband of FIGS. 13-21 in a ninth state of assembly, in accordance with some embodiments of the present disclosure.

As shown in FIG. 22, strap outer segment 154 can be affixed to base 32. For example, an outer stitch 110 can be applied to secure strap 48 to base 32. For example, outer stitch 110 can extend at least partially through strap outer segment 154 and base 32 (i.e., through contact surface 26). Optionally, outer stitch 110 can extend to exterior surfaces of strap outer segment 154 and/or base 32. In some embodiments, outer stitch 110 can extend to a terminal end of strap outer segment 154. Additionally or alternatively, strap outer segment 154 and base 32 can be secured to each other by one or more of a variety of mechanisms, including adhesive, overmolding, bonding, fusing, and the like. In some embodiments, strap outer segment 154 can be affixed to base 32 at only two locations (e.g., the inner stitch and the outer stitch). Between such fixation points, strap outer segment 154 can have a range of movement relative to base 32. Nonetheless, at least some forces applied to strap 48 can be transferred to base 32. Accordingly, the user can manipulate watchband 20 by acting on strap 48.

Figure 23:
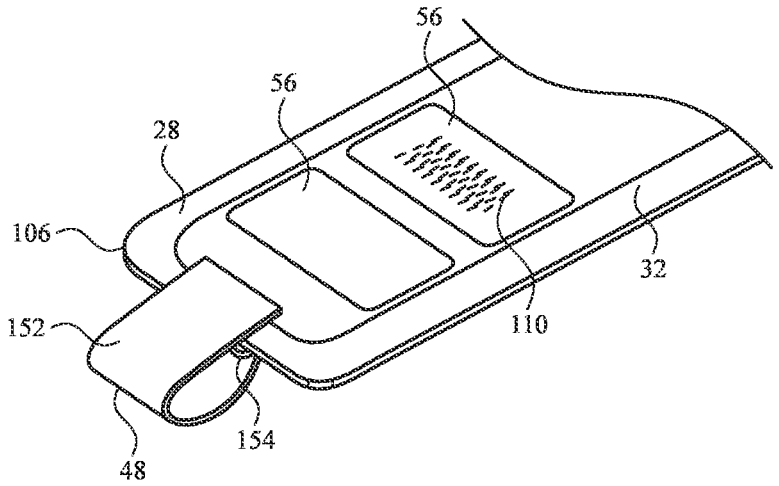
FIG. 23 is a perspective view of the portion of the watchband of FIGS. 13-22 in a tenth state of assembly, in accordance with some embodiments of the present disclosure.

As shown in FIG. 23, one or more hook pads 56 can be provided on engagement surface 28 of base 32. In some embodiments, at least one of hook pads 56 can be positioned over outer stitch 110. Accordingly, the portion of outer stitch 110 that is on the side of engagement surface 28 can be hidden from view. In some embodiments, along engagement surface 28, the one or more hook pads 56 can be positioned a distance away from the location of strap 48. For example, strap 48 can be affixed to engagement surface 28 of base 32 at a location that is between the endmost one of hook pads 56 and free end 106 of base 32.

Figure 24:
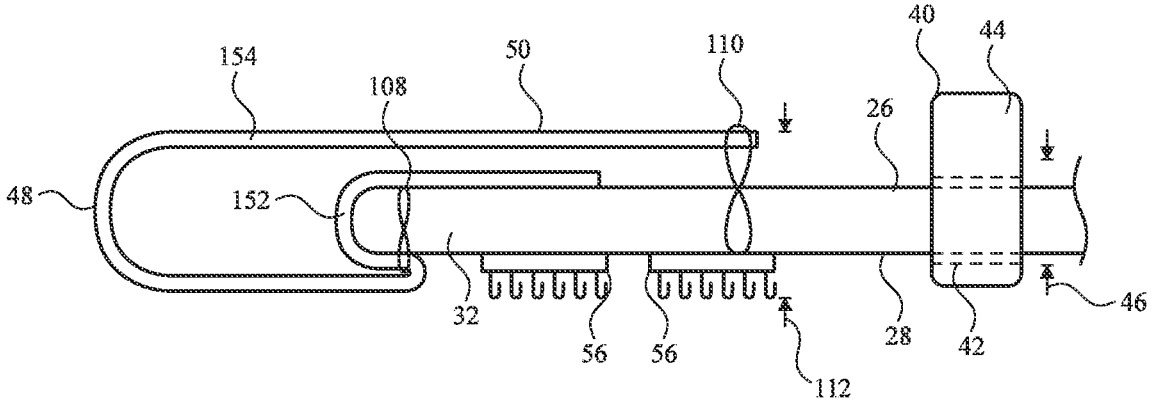
FIG. 24 is a side sectional view of the portion of the watchband of FIGS. 13-23 in the tenth state of assembly, in accordance with some embodiments of the present disclosure.

As shown in FIG. 24, strap 48 and the fixation structures (e.g., outer stitch 110 and/or a hook pad 56) can form tab 50. Tab 50 can, at least in part, form a structure that keeps retaining ring 40 on base 32 of watchband 20. For example, tab 50 has at least one cross-sectional dimension that is larger than at least one cross-sectional dimension of retaining ring hole 42. Tab 50 can have a maximum cross-sectional dimension (e.g., thickness 112), transverse to a longitudinal axis of watchband 20, that is larger than a maximum cross-sectional dimension (e.g., thickness 46) of retaining ring hole 42. As used herein, the thickness is measured in a dimension that is transverse to a longitudinal axis of watchband 20 and extends from and through (e.g., orthogonal to) the substantially flat surfaces of base 32. It will be understood that the thickness of one structure is to be measured in the same or a parallel axis as the thickness of another structure. It will be understood that other dimensions (e.g., width) can additionally or alternatively define the ability of tab 50 to retain retaining ring 40. As shown in FIG. 24, maximum thickness 112 of tab 50 can be defined, at least in part, by the overlapping structures, including outer stitch 110, strap 48, base 32, and/or hook pad 56. Maximum thickness 112 of tab 50 can be measured by, for example, the maximum distance between an end of outer stitch 110 and an end of hook pad 56. While such structures may be individually less thick than maximum thickness 46 of retaining ring hole 42, their combined thickness can prevent passage of retaining ring 40 thereover. In some embodiments, other features can contribute to maximum thickness 112 of tab 50, including underlying layers, embossing, covers, laminates, and the like.

Figure 25:
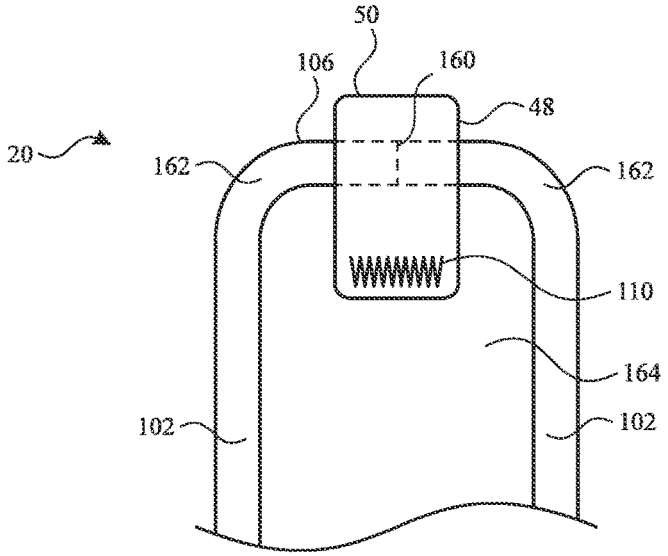
FIG. 25 is a top view of the portion of the watchband of FIGS. 13-24 in the tenth state of assembly, in accordance with some embodiments of the present disclosure.

As shown in FIG. 25, strap 48 of tab 50 can extend over interface 160. As such, strap 48 can at least partially cover interface 160, as well as end portions 162 of edge sections 102. Such a covering can help reinforce the fixation of end portions 162 to central section 168 near free end 106 of watchband 20. Additionally, tab 50 can provide a mechanism for manipulation of free end 106. As the user grasps tab 50, end portions 162 can remain engaged to each other and/or central section 164, at least in part because tab 50 provides a surface for engagement by the user that does not expose interface 160 to direct manipulation by the user. Additionally, tab 50 can hide internal structures, such as the interface stitch, the inner stitch, and/or adhesives or other support structures at the interface.

Figure 26:
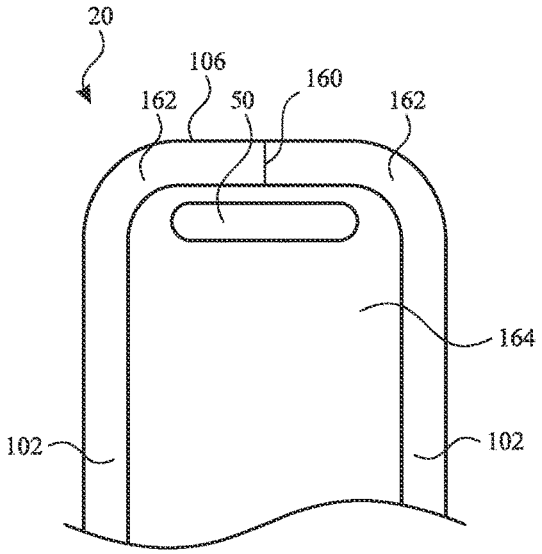
FIG. 26 is a top view of a portion of a watchband, in accordance with some embodiments of the present disclosure.
Figure 27:
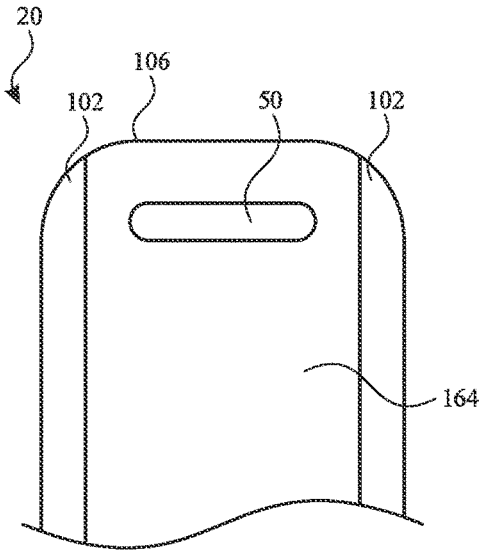
FIG. 27 is a top view of a portion of a watchband, in accordance with some embodiments of the present disclosure.

Referring now to FIGS. 26 and 27, a free end of a watchband can be formed with a stopper that need not include a strap. As shown in FIG. 26, end portions 162 of edge sections 102 can be fixed to each other and/or central section 164 of watchband 20. Interface 160 can include one or more support structures to facilitate fixation as described herein, even if not depicted in FIG. 26. A stopper 114 can include a protruding structure without necessarily including the strap. For example, stopper 114 can include a stitch or other protrusion that is formed with watchband 20, such as at central section 164. Stopper 114 can include, for example, additional layers, an embossed structure, and the like. Along with the base and/or a hook pad, stopper 114 can define a maximum thickness for retaining a retainer ring, as described herein.

As shown in FIG. 27, edge sections 102 need not form end portions that wrap around central section 164. For example, central section 164 and/or edge sections 102 can be shaped to form the desired free end 106 for watchband 20. Central section 164 and/or edge sections 102 can have a termination that manages the threads thereof. For example, central section 164 and/or edge sections 102 can include a cap, seal, covering, overmolded structure, stitch, fused end, and the like to hold the threads in place. As further shown in FIG. 27, stopper 114 can include a protruding structure without necessarily including the strap. For example, stopper 114 can include a stitch or other protrusion that is formed with watchband 20, such as at central section 164. Stopper 114 can include, for example, additional layers, an embossed structure, and the like. Along with the base and/or a hook pad, stopper 114 can define a maximum thickness for retaining a retainer ring, as described herein.

Figure 28:
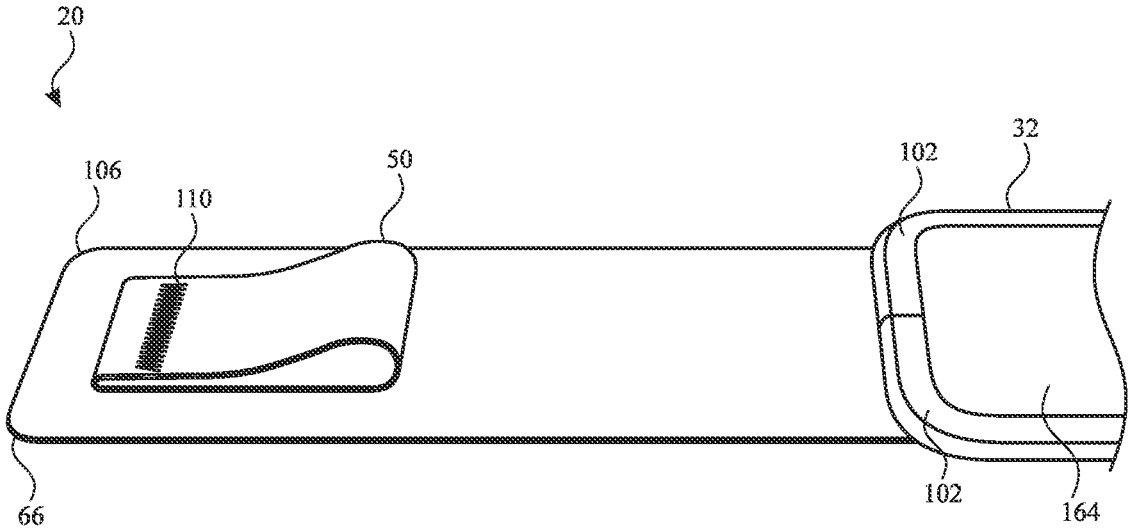
FIG. 28 is a perspective top view of a portion of a watchband, in accordance with some embodiments of the present disclosure.
Figure 29:
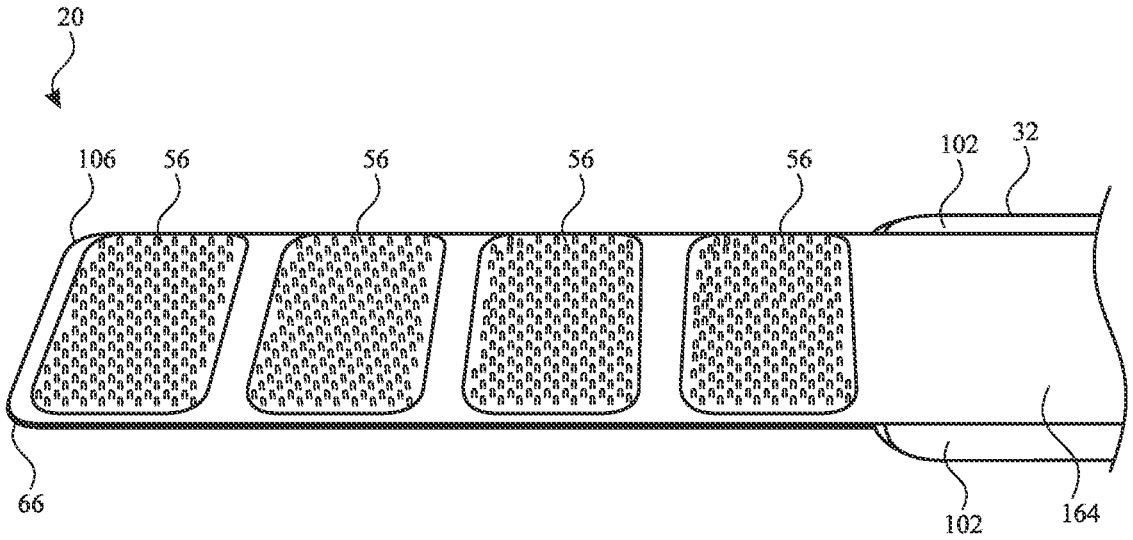
FIG. 29 is a perspective bottom view of the portion of the watchband of FIG. 28, in accordance with some embodiments of the present disclosure.

Referring now to FIGS. 28 and 29, a free end of a watchband can extend beyond other structures to provide both engagement with hooks as well as a tab for manipulation by a user. As shown in FIG. 28, base 32 of a watchband 20 can include a central section 164 as well as edge sections 102 that extend around a terminal end of central section 164, as described herein. As further shown, free end 106 of watchband 20 can be defined by a structure that extends beyond the end portions of edge sections 102. For example, an extension section 66 can be positioned at or near a terminal end of watchband 20 to form free end 106. Tab 50 can be positioned on extension section 66 between free end 106 and base 32. For example, tab 50 can include a strap that is fixed to extension section 66 with an outer stitch 110.

As shown in FIG. 29, extension section 66 can be formed with base 32. For example, extension section 66 can be interwoven with central section 164 and extend beyond the end portions formed by edge sections 102. Extension section 66 can include one or more hook pads 56 to provide engagement with other portions of watchband 20 (e.g., loops). Extension section 66 advantageously provides engagement near free end 106 of watchband 20 to resist forces that would disengage watchband 20 from itself.

Referring now to FIGS. 30-33, a tab of a watchband can include a loop of material that facilitates manipulation by a user. It will be understood that such tabs can be provided as an alternative or in addition to other structures described herein.

Figure 30:
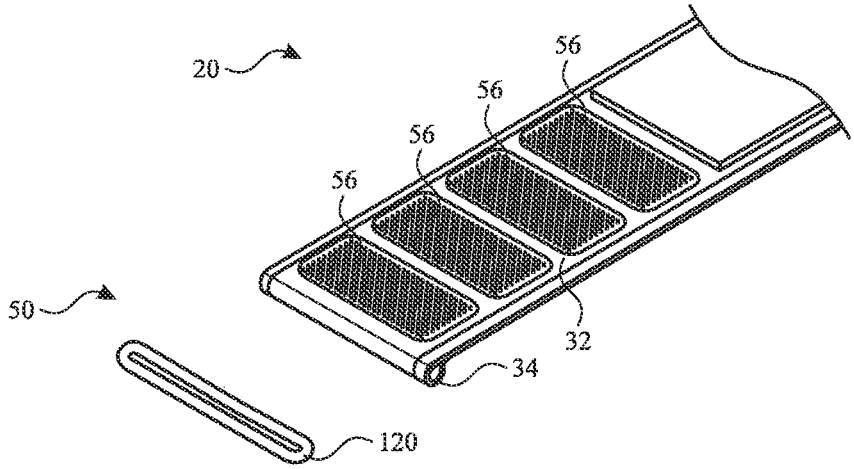
FIG. 30 is a perspective exploded view of a portion of a watchband, in accordance with some embodiments of the present disclosure.

According to some embodiments, for example as shown in FIG. 30, a tab 50 can include a loop 120 that is coupled to base 32 of watchband 20. Loop 120 can include an elastic or otherwise deformable material. The user can grasp loop 120 to pull on or otherwise manipulate watchband 20. Loop 120 of tab 50 can include a hole through which an engagement section 34 of base 32 can extend. For example, a portion of base 32 (i.e., engagement section 34) passes through the hole of loop 120, such that a portion of base 32 overlaps itself. The overlapping portions of base 32 can be affixed to each other, so that base 32 is not removed from loop 120.

Figure 31:
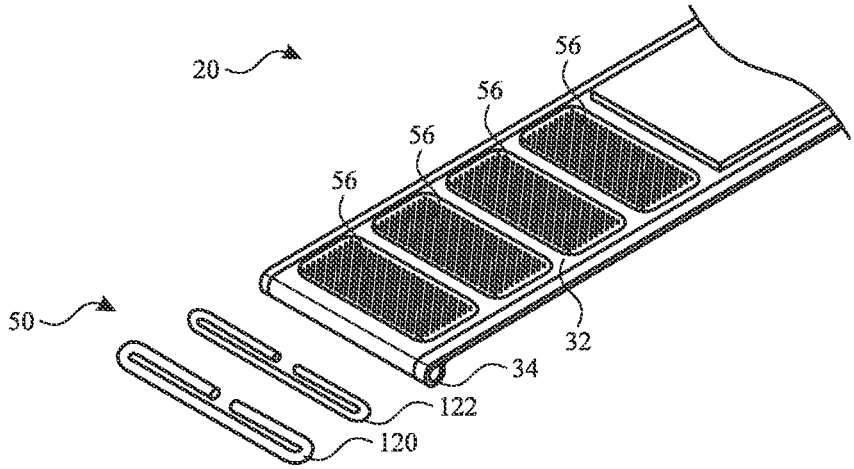
FIG. 31 is a perspective exploded view of a portion of a watchband, in accordance with some embodiments of the present disclosure.

According to some embodiments, for example as shown in FIG. 31, a tab 50 can include a loop 120 that is coupled to base 32 of watchband 20. Loop 120 can be supported by a rigid structure, such as a rigid insert 122 of a metallic material. Loop 120 forming an exterior shell about rigid insert 122 can include a fabric, an elastic, or another deformable material. The rigid insert 122 can define a shape to which loop 120 conforms. The user can grasp loop 120 to pull on or otherwise manipulate watchband 20. Loop 120 of tab 50 can include a hole through which an engagement section 34 of base 32 can extend.

Figure 32:
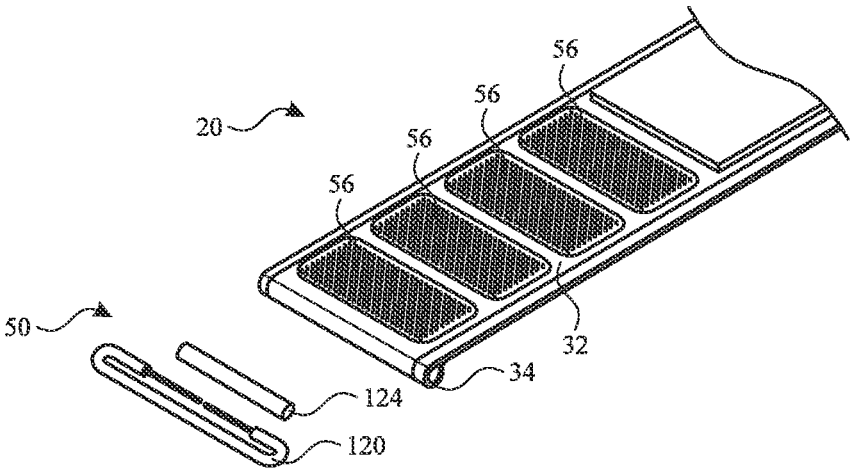
FIG. 32 is a perspective exploded view of a portion of a watchband, in accordance with some embodiments of the present disclosure.

According to some embodiments, for example as shown in FIG. 32, a tab 50 can include a loop 120 that is coupled to base 32 of watchband 20. Loop 120 can be formed by joining ends thereof together with a coupling 124. Loop 120 can include an elastic or otherwise deformable material. Coupling 124 can hold the ends of loop 120 together to maintain a continuous structure. The user can grasp loop 120 to pull on or otherwise manipulate watchband 20. Loop 120 of tab 50 can include a hole through which an engagement section 34 of base 32 can extend. For example, base 32 can extend about coupling 124, which can be hidden from view within base 32.

Figure 33:
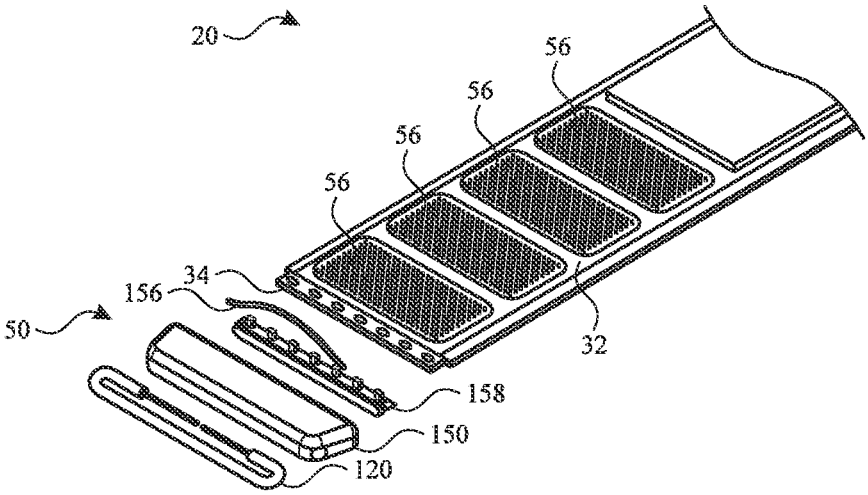
FIG. 33 is a perspective exploded view of a portion of a watchband, in accordance with some embodiments of the present disclosure.

According to some embodiments, for example as shown in FIG. 33, tab 50 can be assembled with a spring element to securely engage base 32 of watchband 20. Base 32 can include an engagement section 34 with which one or more portions of an insert 158 can engage. For example, one or more teeth of insert 158 extend into holes of engagement section 34. A bow spring 156 is provided between insert 158 and a shell 150. When shell 150 is placed over insert 158, the teeth prevent insert 158 from disengaging from engagement section 34. When bow spring 156, within shell 150, extends to a relaxed position, bow spring 156 prevents shell 150 from sliding off of insert 158. Tab 50 can further include a loop 120 that is coupled to shell 150. Loop 120 can have one or more of the features described herein with respect to FIGS. 30-32.

Figure 34:
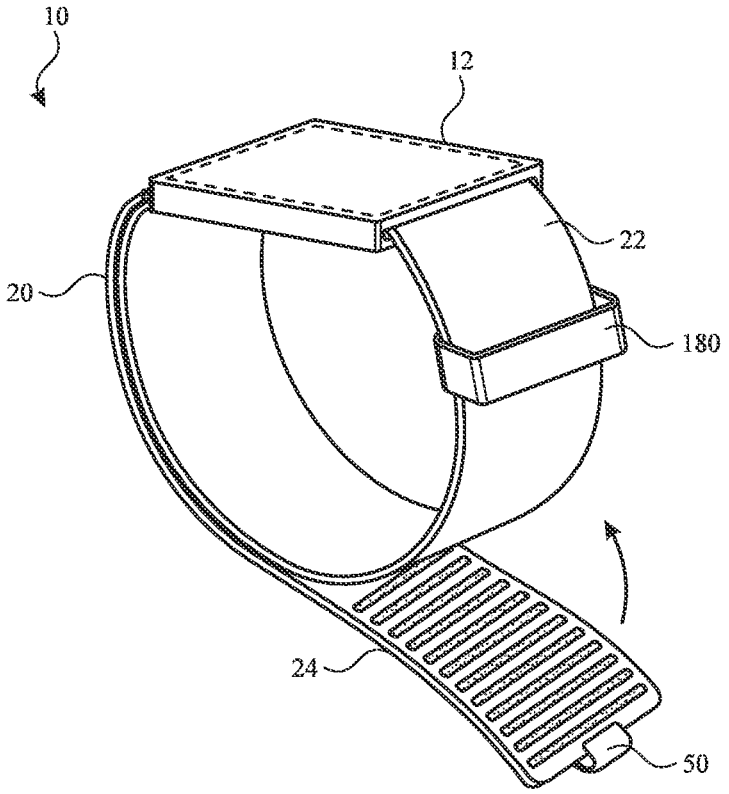
FIG. 34 is a perspective view of a watch, in accordance with some embodiments of the present disclosure.
Figure 35:
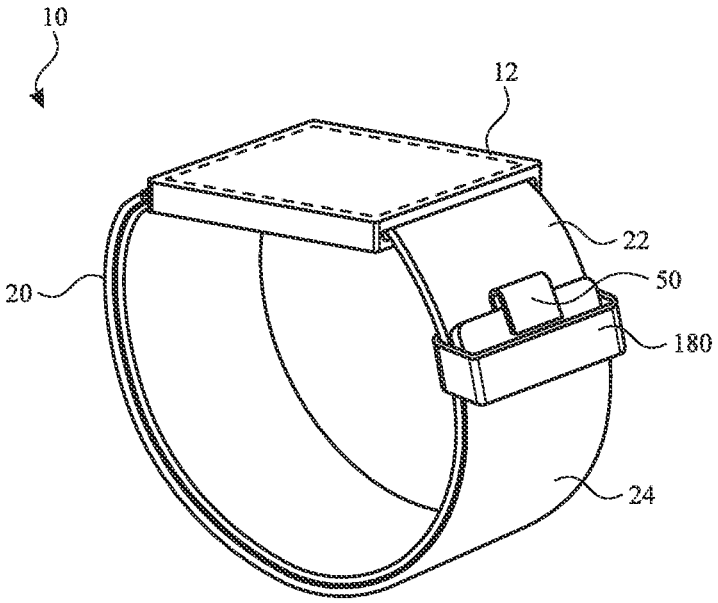
FIG. 35 is a perspective view of the watch of FIG. 34, in accordance with some embodiments of the present disclosure.

Referring now to FIGS. 34 and 35, additional structures can be provided to enhance engagement of the watchband. According to some embodiments, for example as shown in FIGS. 34 and 35, a capture band 180 retains tab 50 when inserted therein. Capture band 180 stretches and/or deforms elastically to receive tab 50 and/or outer portion 24 of watchband 20. As shown in FIGS. 34 and 35, a user can insert at least tab 50 through a portion of capture band 180. Capture band 180 then encompasses a portion of inner portion 22 and outer portion 24. In such an arrangement, capture band 180 provides additional support to keep outer portion 24 engaged with and/or in contact with inner portion 22. Capture band 180 is slideable along a longitudinal length of inner portion 22 and/or outer portion 24. For example, capture band 180 can receive tab 50 and be adjusted to be near tab 50. Capture band 180 is resilient and sized to press outer portion 24 and inner portion 22 together. The user can remove tab 50 and outer portion 24 from capture band 180 by sliding capture band 180 relative to outer portion 24 and tab 50.

While the watchbands disclosed herein include an overlapping arrangement for engagement between hooks and loops, it will be understood that multiple overlapping sections can be provided. For example, the watchband can fold onto itself from each of two regions of engagement with the watch body. For example, two retaining rings can be provided without requiring a housing connector. Where multiple free ends are provided, it will be understood that a corresponding number of tabs can be provided.

Accordingly, embodiments of the present disclosure provide a watchband that can comfortably secure an electronic device to a wrist of a user. The watchband can include a base having a contact surface opposite an engagement surface, contact loops on the contact surface for contacting a user, and engagement loops on the engagement surface for engaging hooks. The hooks can be provided on the engagement surface, opposite some of the contact loops. Edge sections of the base can wrap around a central section to define an end of the base. A tab can extend from an end of the base to facilitate attachment, adjustment, and/or removal of the watch band. The tab can further help maintain the assembled parts in place to enhance durability of the watchband.

Various examples of aspects of the disclosure are described below as clauses for convenience. These are provided as examples, and do not limit the subject technology.

Clause A: a watchband comprising: a base having a contact surface opposite an engagement surface; engagement loops on the engagement surface; hooks on the engagement surface for engaging the engagement loops; a retaining ring slidably retaining the base within a hole of the retaining ring; and a tab comprising a fabric affixed to an end of the base for stopping the base from sliding out from the retaining ring, wherein at least the base and the tab define a maximum thickness that is larger than a maximum thickness of the hole of the retaining ring.

Clause B: a watchband comprising: a base having a contact surface opposite an engagement surface; engagement loops on the engagement surface; a hook pad comprising hooks and positioned on the engagement surface for engaging the engagement loops; and a tab comprising a strap, wherein the strap comprises a strap inner segment and a strap outer segment, wherein the strap inner segment and the strap outer segment each extend from an inner stitch coupling the strap to the engagement surface of the base, wherein the strap outer segment is coupled to the contact surface of the base, and the strap outer segment extends over the strap inner segment and is coupled to the contact surface of the base.

Clause C: A watchband comprising: a central section; loops extending from a surface of the central section; and a pair of edge sections interwoven with the central section along opposing sides of the central section, wherein end portions of each of the edge sections extend beyond and around an end of the central section, the end portions of each of the edge sections being coupled to each other and the end of the central section.

One or more of the above clauses can include one or more of the features described below. It is noted that any of the following clauses may be combined in any combination with each other, and placed into a respective independent clause, e.g., clause A, B, or C.

Clause 1: the tab comprises a strap and a stitch coupling the strap to the base, wherein the maximum thickness at the tab extends from the stitch to the hooks.

Clause 2: contact loops on the contact surface, wherein the hooks are opposite some of the contact loops.

Clause 3: the retaining ring is configured to connect to a first side of a watch body, the watchband further comprising a housing connector affixed to another end of the base and configured to connect to a second side of the watch body.

Clause 4: hook pads supporting the hooks on the engagement surface, each of the hook pads being attached to the base and being spaced apart from every other hook pad along the base.

Clause 5: the inner stitch is longitudinally between the hook pad and an end of the base.

Clause 6: the strap outer segment is coupled to the contact surface of the base by an outer stitch.

Clause 7: the outer stitch extends from the strap outer segment and through the base to the engagement surface, wherein the hook pad covers the outer stitch at the engagement surface.

Clause 8: a retaining ring slidably retaining the base within a hole of the retaining ring, wherein a maximum thickness extending from the outer stitch to the hook pad is larger than a maximum thickness of the hole of the retaining ring.

Clause 9: an interface between the strap inner segment and the base is longitudinally between the outer stitch and an end of the base.

Clause 10: the strap outer segment is coupled to the contact surface of the base with an adhesive.

Clause 11: the strap inner segment abuts an end of the base and the strap outer segment extends away from the end of the base to form a gap between the strap inner segment and the strap outer segment.

Clause 12: the end portions of each of the edge sections are coupled to each other and the end of the central section by a stitch.

Clause 13: the end portions of each of the edge sections are coupled to each other and the end of the central section by an adhesive.

Clause 14: the edge sections each comprise elastic threads extending in parallel alongside the central section and extending along curves where the end portions of each of the edge sections extend around the end of the central section.

Clause 15: a tab comprising a strap extending from the central section and covering an interface between the end portions of the edge sections.

Clause 16: the strap comprises a strap inner segment and a strap outer segment, wherein the strap inner segment and the strap outer segment each extend from a stitch coupling the strap to an engagement surface of the central section, wherein the strap outer segment is coupled to a contact surface of the central section, and the strap outer segment extends over the strap inner segment and is coupled to the contact surface of the central section.

Clause 17: a retaining ring slidably retaining the central section and the edge sections within a hole of the retaining ring; a hook pad comprising hooks and positioned on the central section for engaging the loops; and a tab formed on a side of the central section that is opposite the hook pad, wherein a maximum thickness extending from the tab to the hook pad is larger than a maximum thickness of the hole of the retaining ring.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A watchband comprising:

a base having a contact surface and an engagement surface opposite the contact surface;

engagement loops on the engagement surface;

hooks on the engagement surface for engaging the engagement loops, the hooks being spaced apart from the engagement loops;

a retaining ring slidably retaining the base within a hole of the retaining ring; and a tab comprising:

an inner strap segment covering portions of each of the contact surface and the engagement surface of the base, the inner strap segment being affixed to each of the contact surface and the engagement surface of the base by a first stitch extending through a portion of the inner strap segment, the contact surface, and the engagement surface; and an outer strap segment covering the inner strap segment and affixed to each of the contact surface and the engagement surface of the base by a second stitch extending through a portion of the outer strap segment, the contact surface, and the engagement surface, wherein at least the base and the tab define a maximum thickness that is larger than a maximum thickness of the hole of the retaining ring for stopping the base from sliding out from the retaining ring.

2. The watchband of claim 1, wherein the maximum thickness at the tab extends from the first stitch to the hooks.

3. The watchband of claim 1, further comprising contact loops on the contact surface, wherein the hooks are opposite some of the contact loops.

4. The watchband of claim 1, wherein the retaining ring is configured to connect to a first side of a watch body, the watchband further comprising a housing connector affixed to another end of the base and configured to connect to a second side of the watch body.

5. The watchband of claim 1, further comprising hook pads supporting the hooks on the engagement surface, each of the hook pads being attached to the base and being spaced apart from every other hook pad along the base, wherein one of the hook pads covers a portion of the second stitch that is on the engagement surface.

6. A watchband comprising:

a base having a contact surface opposite an engagement surface;

engagement loops on the engagement surface;

a hook pad comprising hooks and positioned on the engagement surface for engaging the engagement loops, the hook pad being spaced apart from the engagement loops; and a tab comprising a strap, wherein the strap comprises a strap inner segment and a strap outer segment, wherein the strap inner segment and the strap outer segment each extend from an inner stitch coupling the strap to the engagement surface of the base, wherein the strap inner segment is coupled to the contact surface of the base, and the strap outer segment extends over the strap inner segment and is coupled to the contact surface of the base.

7. The watchband of claim 6, wherein the inner stitch is longitudinally between the hook pad and an end of the base.

8. The watchband of claim 6, wherein the strap outer segment is coupled to the contact surface of the base by an outer stitch.

9. The watchband of claim 8, wherein the outer stitch extends from the strap outer segment and through the base to the engagement surface, wherein the hook pad covers the outer stitch at the engagement surface.

10. The watchband of claim 8, further comprising a retaining ring slidably retaining the base within a hole of the retaining ring, wherein a maximum thickness extending from the outer stitch to the hook pad is larger than a maximum thickness of the hole of the retaining ring.

11. The watchband of claim 8, wherein an interface between the strap inner segment and the base is longitudinally between the outer stitch and an end of the base.

12. The watchband of claim 6, wherein the strap outer segment is coupled to the contact surface of the base with an adhesive.

13. The watchband of claim 6, wherein the strap inner segment abuts an end of the base and the strap outer segment extends away from the end of the base to form a gap between the strap inner segment and the strap outer segment.

14. A watchband comprising:

a central section extending longitudinally along a length of the watchband, the central section comprising first woven threads;

loops extending from a surface of the central section; and a pair of edge sections interwoven with the central section along opposing sides of the central section, the edge sections comprising second woven threads different from the first woven threads, wherein end portions of each of the edge sections, defined at least in part by the second woven threads, extend longitudinally along the central section, beyond an end of the central section, and laterally around the end of the central section, the end portions of each of the edge sections being coupled to each other and the end of the central section.

15. The watchband of claim 14, wherein the end portions of each of the edge sections are coupled to each other and the end of the central section by a stitch.

16. The watchband of claim 14, wherein the end portions of each of the edge sections are coupled to each other and the end of the central section by an adhesive.

17. The watchband of claim 14, wherein the edge sections each comprise elastic threads extending in parallel alongside the central section and extending along curves where the end portions of each of the edge sections extend around the end of the central section.

18. The watchband of claim 14, further comprising a tab comprising a strap extending from the central section and covering an interface between the end portions of the edge sections.

19. The watchband of claim 18, wherein the strap comprises a strap inner segment and a strap outer segment, wherein the strap inner segment and the strap outer segment each extend from a stitch coupling the strap to an engagement surface of the central section, wherein the strap outer segment is coupled to a contact surface of the central section, and the strap outer segment extends over the strap inner segment and is coupled to the contact surface of the central section.

20. The watchband of claim 14, further comprising:

a retaining ring slidably retaining the central section and the edge sections within a hole of the retaining ring;

a hook pad comprising hooks and positioned on the central section for engaging the loops; and a tab formed on a side of the central section that is opposite the hook pad, wherein a maximum thickness extending from the tab to the hook pad is larger than a maximum thickness of the hole of the retaining ring.

* * * * *